US012442296B2

(12) United States Patent
Berger

(10) Patent No.: US 12,442,296 B2
(45) Date of Patent: Oct. 14, 2025

(54) INTELLIGENT WELL TESTING SYSTEM

(71) Applicant: TESTALL AS, Skien (NO)

(72) Inventor: Per Erik Berger, Skien (NO)

(73) Assignee: TESTALL AS, Skien (NO)

( * ) Notice: Subject to any disclaimer, the term of this patent is extended or adjusted under 35 U.S.C. 154(b) by 0 days.

(21) Appl. No.: 18/723,434

(22) PCT Filed: Dec. 23, 2022

(86) PCT No.: PCT/EP2022/087765
§ 371 (c)(1),
(2) Date: Jun. 23, 2024

(87) PCT Pub. No.: WO2023/118580
PCT Pub. Date: Jun. 29, 2023

(65) Prior Publication Data

US 2025/0059888 A1 Feb. 20, 2025

(30) Foreign Application Priority Data

Dec. 23, 2021 (NO) ..... 20211590

(51) Int. Cl.
*E21B 49/08* (2006.01)
*E21B 47/11* (2012.01)
*E21B 47/12* (2012.01)

(52) U.S. Cl.
CPC ..... *E21B 49/088* (2013.01); *E21B 47/11* (2020.05); *E21B 47/138* (2020.05)

(58) Field of Classification Search
CPC ..... E21B 49/088; E21B 47/11; E21B 47/138; E21B 41/0035
See application file for complete search history.

(56) References Cited

U.S. PATENT DOCUMENTS 5,799,733 A * 9/1998 Ringgenberg ..... E21B 33/1243 166/147
6,157,893 A 12/2000 Berger et al.
(Continued)

FOREIGN PATENT DOCUMENTS

AU 9206201 A 4/2002
CN 107923236 A 4/2018
(Continued)

OTHER PUBLICATIONS

Julian Youxiang Zuo, Adriaan Gisolg, "A Breakthrough in Accurate Down hole Fluid Sample Contamination Prediction", SPWLA 56th Annual Logging Symposium, Jul. 18-22, 2015, https://www.researchgate.net/publication/299135540 https://www.researchgate.net/publication/299135540.
(Continued)

*Primary Examiner* — Shane Bomar
(74) *Attorney, Agent, or Firm* — Rivka Friedman

(57) ABSTRACT

A method and apparatus for characterizing reservoir properties when producing formation fluids from a subsurface formation by releasing material(s) with distinct signature(s) into the formation fluids, allowing said material to flow through the reservoir with the formation fluids, registering the receipt of said material in a downhole well testing system or on surface of a production well, and determining the time, distance and direction of travel for the said material and using these parameters to determine permeability and/or mobility in the relevant direction of flow in the reservoir. Upon completion of a well test, the formation fluids may be re-injected into the formation it was produced from. The well testing system further includes downhole sensors for measuring parameters characterizing the formation fluids and a two-way communication system for transmitting information to surface.

26 Claims, 14 Drawing Sheets

(56) References Cited

U.S. PATENT DOCUMENTS

| | | | | |
|---|---|---|---|---|
| 6,325,146 | B1 * | 12/2001 | Ringgenberg | E21B 43/129 166/264 |
| 6,675,892 | B2 | 1/2004 | Ramakrishnan | |
| 7,784,539 | B2 | 8/2010 | Montaron | |
| 7,849,920 | B2 | 12/2010 | Kannan | |
| 8,244,509 | B2 | 8/2012 | Banerjee et al. | |
| 8,776,591 | B2 | 7/2014 | Le Foll et al. | |
| 9,926,774 | B2 | 3/2018 | Fontenot et al. | |
| 10,017,995 | B2 | 7/2018 | Dawson | |
| 10,107,095 | B2 | 10/2018 | Christian et al. | |
| 10,233,749 | B2 | 3/2019 | Anisur Rahman | |
| 10,408,047 | B2 | 9/2019 | Morrow | |
| 10,626,721 | B2 * | 4/2020 | Gisolf | E21B 49/08 |
| 11,313,215 | B2 | 4/2022 | Yi et al. | |
| 12,338,734 | B1 * | 6/2025 | Ringgenberg | E21B 49/0875 |
| 2002/0185273 | A1 * | 12/2002 | Aronstam | E21B 47/138 166/250.01 |
| 2009/0234584 | A1 | 9/2009 | Casey et al. | |
| 2010/0076740 | A1 | 3/2010 | Kuchuk et al. | |
| 2011/0297371 | A1 | 12/2011 | Church et al. | |
| 2012/0312530 | A1 * | 12/2012 | Pope | E21B 49/087 250/269.1 |
| 2020/0141233 | A1 | 5/2020 | Allouche et al. | |
| 2021/0277747 | A1 * | 9/2021 | Al Naimi | E21B 47/10 |
| 2021/0310352 | A1 * | 10/2021 | Pelletier | E21B 49/10 |
| 2021/0363883 | A1 * | 11/2021 | Jones | E21B 49/08 |
| 2023/0109552 | A1 * | 4/2023 | Heller | E21B 49/08 702/12 |
| 2024/0018868 | A1 | 1/2024 | Temer et al. | |

FOREIGN PATENT DOCUMENTS

| | | | |
|---|---|---|---|
| CN | 110714752 | A | 1/2020 |
| CN | 113874597 | A | 12/2021 |
| CN | 118159715 | A | 6/2024 |
| MX | PA02008508 | A | 1/2003 |

OTHER PUBLICATIONS

Ulugbek Djuraev, Shiferaw Regassa Jufar, Pandian Vasant, "A review on conceptual and practical oil and gas reservoir monitoring methods", Journal of Petroleum Science and Engineering, vol. 152, Apr. 2017, pp. 586-601, https://doi.org/10.1016/j.petrol.2017.01.038 https://www.sciencedirect.com/science/article/pii/S0920410517301493.

Yang Wang, Shiqing Cheng, Kaidi Zhang, Youwei He, Nauchao Feng, Jiazheng Qin, Le Luo, Haiyang Yu, "A Comprehensive Work Flow to Characterize Waterflood-induced Fractures by Integrating Real-Time Monitoring, Formation Test, and Dynamic Production Analysis Applied to Changqing oil Field", SPE Reservoir EvALUATION & Engineering, Aug. 29, 2018, https://doi.org/10.2118/191370-PA https://onepetro.org/REE/article-abstract/22/02/692/206951/A-Comprehensive-Work-Flow-To-Characterize.

Gang Bi, Shuaishuai Fu, Jinlong Wang, Jiemin Wu, Peijie Yuan, Xianbo Peng, Min Wang, Yongfeng Gong, "Research on Structural Design and Optimisation Analysis of a Downhole Multi-Parameter Real-Time Monitoring System for Intelligient Well Completion", vol. 12, Jul. 30, 2024, 10.3390/pr12081597, https://doi.org/10.3390/pr12081597 https://www.mdpi.com/2227-9717/12/8/1597.

Olusile Akinyele Babayeju, Dazok Donald Jambol, Andrew Emuobosa Esiri, "Reducing drilling risks through enhanced reservoir characterization for safer oil and gas operations", GSC Advanced Research and Reviews, 2024, 19(03), pp. 086-101, Jun. 10, 2024, https://doi.org/10.30574/gscarr.2024.19.3.0205 https://gsconlinepress.com/journals/gscarr/content/reducing-drilling-risks-through-enhanced-reservoir-characterization-safer-oil-and-gas.

* cited by examiner

INTELLIGENT WELL TESTING SYSTEM

The present invention relates generally to production testing of fluids from subterrain formations, and more specifically to a method and apparatus for measuring different properties of fluids and subterrain formations including detection of released tracer material while producing formation fluids.

BACKGROUND OF THE INVENTION

The process of testing subterrain formations typically involves drilling down through a reservoir with a conventional drilling assembly. During the drilling process, a core sample may or may not be collected by means of a coring assembly.

The properties of the reservoir rock are logged either while drilling by the means of logging sensors that are used to measure formation properties during the drilling process, known as Measurement While Drilling (MWD) systems and Logging While Drilling (LWD) systems, or it is logged after drilling by the means of Wireline Logging devices, or both. From the log data, the core data, the drill cuttings, and other sources of information from a zone of interest for performing a production test may be identified.

The main purpose of the production test is to measure the productivity and other parameters concerning the formation of interest and the fluids contained therein to determine the production capability and reservoir characteristics of the formation of interest.

Production testing is carried out to acquire data to determine a variety of characteristics of oil and gas reservoirs, including flow characteristics, such as the permeability and mobility. The permeability may be measured both in horizontal and vertical direction. However, to determine horizontal permeability, a solution has yet to be presented that allows determination of the horizontal permeability in various geographic directions, such as north-south or east-west. Knowledge of variations in permeability and mobility in a reservoir depending on the direction of flow may have a considerable impact on selection of reservoir drainage strategies, including but not limited to placement of production and injection wellbores. The present invention addresses these shortcomings of present technology.

A variety of production testing methods are known. Production tests are performed prior to completing a well, such as in open holes as well as in cased holes through a perforated liner, or in completed wells where a production string has been installed in the well for providing a permanent flow path to the surface production equipment.

Production testing of a formation in an open hole may include a variety of techniques, from small scale testing performed with a wireline conveyed formation tester or a Logging While Drilling formation testing tool where the formation fluid is produced into a downhole test tool, or a full-scale production test where the formation fluid is produced to surface through a production tubing that is temporarily installed for the test.

The wireline formation tester and the Logging While Drilling formation tester both typically test only a small portion of the wellbore and formation through a small probe that is pressed into the formation at the borehole wall with a sealing arrangement arranged around the probe, or with a dual-packer arrangement where a larger section of the borehole is isolated, typically 1-2 meter between the packer elements, known in the art as straddle-packers. However, both solutions offer a limited capacity to test and sample only small volumes of a few litres. In some advanced wireline or Logging While Drilling formation tester tools, downhole sensor and measurement capability is built into a tool to provide downhole analysis of the composition of the produced fluids.

A full-scale production test, commonly referred to as a Drill Stem Test (DST), would allow production of formation fluids to be received on the surface through a well test process system that includes light treatment and eventually burning off the produced hydrocarbons, commonly referred to as flaring. This has serious HSE effects, such as the safety risk of receiving the produced fluids at high pressure on surface, and a significant environmental effect from pollution and CO2 emission when burning the produced hydrocarbons. An advantage of using the conventional drill stem test method is that the produced volumes may be as large as needed to conduct an extensive test of the reservoir, without volume restrictions. In many cases a long test with high volumes will be required to identify boundaries of the downhole reservoir and sufficiently map the extent of the reservoir and consequently the total volumes of hydrocarbons that may be produced. Furthermore, fluid samples may be collected frequently on surface and brought to the laboratory for analysis.

It is worth noting that collecting fluid samples on the surface is not the best solution. Collecting fluid samples downhole at in situ conditions is a better solution. When fluids are produced to surface, pressure and temperature will decrease and the fluids may undergo changes because of this and be less representative of the fluid in the reservoir.

An intermediate volume well test method has been introduced where a wireline formation tester tool is used and where produced volumes are diverted into the annular space between a tester and the borehole wall, above the tester. This is known as the Formation Testing While Tripping tool, FTWD. The hydrocarbons that are produced in the well test will then migrate up the annulus and once it reaches the surface rig it is treated on the surface through the mud processing system. With this system it is possible to pump much higher volumes than conventional wireline formation testing, however, as the hydrocarbons reach the surface they must be treated and there are safety concerns and environmental effects be receiving the fluids on surface through the drilling mud.

There is a need to develop a well testing solution that can be performed downhole without producing the hydrocarbons to the surface, with associated safety and environmental concerns, and at the same time enable sufficient test volumes to render an adequate well test from a reservoir analysis point-of-view. This would require greater production volumes than possible with conventional wireline formation testers, Logging While Drilling formation testers or even Formation Testing While Tripping formation testers. This is because, in all these cases the volumes are limited to the volume that can be collected in a sample chamber, or in the case of the Formation Testing While Tripping, the volume that can be safely contained and processed within the borehole annular volumes. Furthermore, it will require advanced downhole sensing and measurement technology to perform the analysis downhole. There is also a need to develop downhole well testing technology that is capable of measuring permeability and mobility in different directions.

A production test usually undergoes two phases, each with a duration of several hours to a few days. The first phase is commonly known as the draw-down phase, which essentially means the reservoir fluid is allowed to flow into the well test equipment. Initially during draw-down, the fluid adjacent the production zone flows into the well, but gradually the fluid from greater distances will flow into the well. When reservoir fluid flows into the well, material is removed from the reservoir and hence the pressure in the reservoir will decrease. This pressure decrease is most significant closest to the wellbore and gradually decreases further away from the wellbore. This is because the reservoir fluid will flow predominantly radially towards the production well. The pressure in the well decreases because the fluid must flow over a longer distance through the formation, subjecting it to increasing pressure loss. When a constant flow rate from a particular zone is maintained, then the pressure in the well depends only on the character of the formation and the fluids contained therein. During the first phase of a production test, previously referred to as the draw-down phase, the pressure draw-down and temperature measurements over time are recorded. In this phase it is common to ensure a constant flow rate. In the second phase of the production test, commonly referred to as the build-up phase, the fluid flow from the production zone being tested is stopped by closing the well test flow path. The pressure within the well then gradually rises to the formation pressure as the fluids will flow towards lower pressure areas around the wellbore in search of pressure equilibrium. The pressure build-up and temperature over time are recorded. The pressure, temperature and the flow-rate measurements are used to analyse the reservoir characteristics, as well as analysis of the composition of the produced fluid.

During the first phase of production testing in a conventional DST test, the formation fluid is directed to the surface via a tubing. Packers in the annulus between the tubing and the well, or the tubing and the perforated liner, are placed to seal the annulus so the formation fluid will flow through the tubing and not through the annulus. A flow control valve at the upper end of the tubing at the surface is used to control the flow of the fluid from the formation. Downhole pumps are sometimes installed to maintain a desired fluid flow rate.

The method described above, and other known production testing methods, commonly require flowing of substantial amounts of formation fluid to the surface during the draw-down phase of the production test. Such methods suffer from several disadvantages. FIG. 1 illustrates a general arrangement of a conventional well test system.

Drilling rigs used to drill exploration and appraisal wells where DST production tests are performed do commonly not include adequate surface facilities to process the formation fluid brought to the surface. Reservoir fluid possesses a safety risk as it is flammable and hazardous to the environment. Therefore, substantial safety measures are taken in connection with such production tests. To reduce the environmental risks, the reservoir fluid is usually burned off at the well site, even if this has a considerable negative environmental effect when emitting polluting gases to the air. Producing fluids to the surface also means that there is an open communication channel from the reservoir to the surface, and the pressures of the reservoir need to be controlled at the surface in a safe manner. This poses a safety risk in addition to the environmental impact. Operators may perform production testing in an alternative way where the produced fluids are collected and transported to suitable offsite processing plant capable of handling the produced fluids. This may reduce the environmental impact but will still represent a safety hazard as well as being a costly operation involving additional personnel and equipment.

Before conducting production testing, a casing or liner is often cemented in the well to insulate various permeable layers, and to comply with safety requirements. Commonly, a special production tubing is installed to provide communication between the surface equipment and down to a zone to be tested. These preparations are time-consuming and expensive. Safety considerations make it sometimes necessary to strengthen an already set casing, perhaps over the entire or a substantial part of the length of the well, and particularly in high pressure wells where it might be required to install extra casings in the upper parts of the well. This is because the high pressure in the reservoir is brought to the surface.

Furthermore, in ordinary production it is common to use various forms of well stimulation. Such stimulation may include injection of chemicals into the formation to increase the flowrate. Another method of well stimulation includes subjecting the formation to increased pressure until cracks are developing and, thus, becomes more permeable. Such methods are referred to as "fracturing" of the formation. A side-effect of fracturing can be a large increase in the amount of sand or other formation rock particles accompanying the reservoir fluid. In connection with production testing, it may in some instances be of interest perform well stimulation operations and to observe the effect thereof.

As mentioned, the present invention relates to production testing of fluids from subterrain formations. More specifically the invention relates to a method and apparatus for drilling a main production wellbore with one or more additional injection wellbores sidetracked from the main wellbore to intersect the same subterrain formation, and releasing chemical tracer material in the said one or more additional injection wellbores and performing a downhole production test in the main production wellbore where the said chemical tracer is flowing through the formation of interest into the well test system where it is detected.

Although the description of the present invention is focused on well testing of exploration and appraisal wells, it is also applicable and usable in production and injections wells. As previously discussed, in drilling of exploration and appraisal wells, a typical drilling rig does not have adequate processing facilities to handle the produced hydrocarbons without flaring. Well testing of permanently installed production or injection wells, however, will normally benefit from such processing capacity, therefore flaring and CO2 emissions are lower than in the exploration or appraisal phase.

There are also other benefits of the present invention, such as the ability to determine directional permeability and directional mobility, that also makes the present invention applicable for well testing of permanently established production or injection wells. More specifically, the part of the present invention that may be permanently installed as part of a field development is an isolated chemical tracer material release device, also referred to as an isolated drone chemical release module which is further described below. It essentially allows to release chemical tracer material of unique signature on command or at known times. This chemical tracer material will subsequently flow through the reservoir from the point where it was released and into a production well where it may be detected by a downhole sensor device or produced to surface and detected by the said sensor device there, if not installed downhole.

One aspect of installing the present invention in one or more wellbores as a permanent installation as part of a field development is the ability to monitor changes in certain key reservoir properties over time. This is also further described below.

It is well known in the art that reservoir parameters may vary throughout the reservoir. One of the important parameters determining the reservoir properties is the porosity, e.g., the volume of pore space in a defined volume of rock. High porosity values mean there is more space in the rock that may be occupied by valuable hydrocarbons. It is also of interest to know how much of the pore space that is interconnected. Interconnected pores will allow hydrocarbons to flow from its original location to a production wellbore. Many factors will decide how easily the hydrocarbons will flow to the production wellbore, such as the size and geometry of the pore spaces, the amount of the relevant fluid that occupy the pore space, the mix and composition of the fluid relative to other fluids, such as water, oil and gas, the viscosity of the flowing fluid, the pressure drop between the location of the hydrocarbon and the production wellbore. Another factor is the permeability, which essentially is a measure of how easily a specific fluid, such as a hydrocarbon, may pass through the rock and move towards the production wellbore. The permeability includes many of the previously mentioned variables. Mobility is another related essential parameter, which considers the viscosity of the flowing fluid and thus is expressed as permeability over viscosity. Permeability is commonly measured in millidarcy (mD) and viscosity in centipoise (cP), hence mobility is determined as (mD/cP).

As can be understood, the permeability and mobility are of great importance in reservoir engineering, and it is very desirable to be able to quantify these parameters. As with the porosity, the permeability may vary throughout the reservoir and may further be different depending on the direction of flow. This is because the material that once where deposited and represent the reservoir was not evenly distributed and subject to a variety of external forces. It is a result of geological processes and may have local variations, as well as variations depending on the direction of flow. Typically, horizontal permeability is greater than vertical permeability. This is a result of compression of the rock in the reservoir when new sediments are deposited from above and subjecting it to increasing weight and pressure. The result in terms of reservoir properties is that it is easier for the fluid to flow in a horizontal than in a vertical direction. Furthermore, the permeability may also vary in the horizontal plane. In other words, it might be different in the North-South direction compared to the East-West direction. To provide more valuable information from a production test, it would be desirable to be able to measure the permeability in different directions as part of the production test. In well testing and production testing analysis it is common to assume a radial flow into the wellbore, which essentially means that the concept of directional permeability is neglected. It is assumed that the reservoir fluid is flowing equally in all directions towards the wellbore, which may not be true if the reservoir rock was originally deposited in a directional manner, such as by a river flowing into the sea.

Furthermore, the permeability and mobility of oil and gas may vary over time. For fluids such as oil to flow through the reservoir, not only the pore space needs to be interconnected, but also the hydrocarbons must be interconnected. Isolated oil drops will not be able to flow, they will be left behind. When an oil or gas field is put on production, more and more of the hydrocarbons will be removed from the reservoir and the space they once occupied will be filled with other fluids. For instance, when producing oil, water may migrate up from below or gas may migrate down from above, taking up space that was previously occupied by oil. The result is that the permeability and mobility that was measured for oil during the exploration phase, before the production of the oilfield was started, will decrease over time as more and more of the oil is replaced by other fluids, resulting in less of the pore space being occupied by the oil thus decreasing the interconnectivity of the oil phase. This change in oil permeability and oil mobility over time will not be constant throughout the reservoir but will be a result of how much oil is produced in various parts of the reservoir. In the present invention, the isolated drone chemical release module will render a valuable solution to monitor local changes in directional permeability and directional mobility over time.

One method to determine the permeability and other characteristics more precisely is using chemical tracers. It may then be possible to estimate how long time it would take for the fluid including the tracer to move from the point where it was released through the formation until it was produced and detected. This method has been used where the chemical tracer has been released in an injection well and subsequently detected in a production well after flowing through the reservoir. However, as the injection well and the production well would be permanent installations, this release of chemical tracer is most commonly not instantaneous but happens over time as the material containing the chemical tracer is degraded or worn away by the injection fluid, thus slowly and gradually being released into the flow over a period of many weeks or months. Similarly, at the other end, the chemical tracer is not detected downhole upon completing its journey through the reservoir and entering the production wellbore. More commonly, the chemical tracer is not detected until it reaches the surface processing equipment of the production well. This means both the release of, and the detection of the chemical tracer is not very precise as it happens over time.

Furthermore, both the injection well and the production well have been established as part of a field development, and as such represent a permanent installation with the ability to either produce from or inject into the reservoir. As this solution is part of the field development, the information obtained from these tests are useful for obtaining a greater understanding of how fluid may flow through the reservoir rock, but it is too late to be used for the planning optimum position of the wells that have already been drilled and completed. It is a significant disadvantage with this method that it is not deployed during the exploration and appraisal drilling phase, but a considerable time, perhaps many years later, and only after several wells have already been drilled and completed. At this point the drainage strategy and reservoir management strategies have already been implemented over several years. Ideally this critical information would be available during exploration drilling and well testing, prior to deciding the reservoir management strategies.

The present innovation addresses said shortcomings of prior art, by a solution where chemical tracer material is used in a single well or several wells, in the exploration or appraisal phase, to increase reservoir understanding including critical parameters such as directional permeability and directional mobility.

SUMMARY OF THE INVENTION

The present invention provides systems and methods for performing production testing in a main wellbore, where the produced fluids may be collected or re-injected into the formation of interest after the well test operation has been performed.

The invention essentially comprises a test string for testing a production zone intersecting a main wellbore. The string further comprises a fluid communication member allowing fluid therethrough, a sealing device for isolating a production zone intersecting the main wellbore to allow fluid flow from the production zone into the fluid communication member, a means for drilling one or more sidetracked injection wellbores intersecting the formation to be tested, chemical tracers placed in the said one or more injection wellbores, a means for releasing the said chemical tracer material, a device for detecting the chemical signature of the tracers upon entry into the well testing system, flow control and power and communication devices.

During a well test, formation fluids may be collected in large sample chambers as part of the well test system, or it may be produced to surface by migrating through the annular space between the wellbore/casing and the test string, or it may be produced to surface through a test string, or it may be temporary injected in another permeable zone downhole. Some of the produced fluid will be produced into permanent sample chambers for collection and retrieval to surface and subsequent analysis. Upon completion of the well test process the remaining produced fluids that are not required for sampling may be reinjected into the reservoir for permanent disposal using a downhole pump, valve, electronics, and control system that is an integral part of the well test system.

The present invention may further provide systems and methods for performing production testing in a main wellbore with chemical tracers released from one or more sidetracked laterals from the main wellbore. In a preferred embodiment, each sidetracked lateral may contain one or more chemical tracers that may be released on command, or at a certain and determined point in time. During a production test the chemical tracer material will be transported through the reservoir formation with the flowing hydrocarbons towards the main production wellbore, and upon entry of the same, it will be detected by the means of one or more sensors. Furthermore, the plurality of sidetracked wellbores around the main wellbore may contain chemical tracers with different characteristics, meaning that it will be possible to know what wellbore each of the chemical tracers were released from, as well as the time it takes for each said chemical tracer to travel through the reservoir, and the distance travelled.

As can be understood, the production test may also be performed in one or more sidetracked wellbores with the chemical tracer material released from the main wellbore and/or other sidetracked wellbores. The main principle of the invention is to use at least two connected wellbores where the production test is carried out in at least one wellbore and the chemical tracer material is released from at least one connected wellbore and with both wellbores intersecting the same reservoir rock.

It should be added that such a system with a downhole controllable means of releasing chemical tracer material on command may not only be used in the exploration and appraisal phase. The chemical tracer material release device, also referred to as an isolated drone, may be left behind after it was used for a production test in the exploration or appraisal phase and used again later after the field development phase has started, thus providing a permanent solution where chemical tracer material may be released when needed. Furthermore, as can be understood, chemical tracer material release devices may also be installed in permanent production or injection wells as part of the field development. The chemical tracer material will then be released periodically or continuously, thereby offering a permanent monitoring solution of reservoir productivity.

During the life of a field the liquid composition of the reservoir fluids will change. The relative saturation of gas, oil and water may change over time as fluids are extracted from or injected into the reservoir. Changes in reservoir pressure is another factor that may result in changes in the fluid composition. Changes in fluid composition are not evenly distributed in the reservoir, they are a result of local factors, such as how much hydrocarbons that are produced, if gas or water is injected nearby, proximity to gas-oil contacts or oil-water contacts, and several other factors. These changes will result in changes in the relative permeability, the viscosity of and therefore also the mobility of the reservoir fluid. Consequently, the mobility is not a constant, but a parameter that may vary over time. The ability to monitor these changes over time may be vital for optimizing the drainage strategies throughout the life of a field. As previously discussed, a common assumption in conventional well testing is to assume the permeability and mobility is equal in all directions and the reservoir fluid is flowing radially into the wellbore during well testing. The present invention challenges this assumption and offer a solution whereby the permeability and mobility are measured in different directions, thus introducing the concept of directional permeability and directional mobility. As such, the present invention offers a true 3D reservoir mapping as far as permeability and mobility is concerned. Furthermore, by introducing a method of monitoring or testing the directional permeability and directional mobility over time, this brings in time as a fourth dimension, thus rendering 4D permeability and 4D mobility a possibility.

The invention further includes a variety of sensors to measure different characteristics of the produced fluids and various well-test parameters during the execution of the well test. This may include, but is not limited to pressure, temperature, viscosity, chemical composition, chemical tracer detection, flowrate, volume, location of main production wellbore, location of a plurality of sidetracked wellbores, location of the one or more chemical tracer release chambers, date, and time.

The invention further includes power and communication system for providing power to the downhole sensors, electronics, motors, and instrumentation as well as providing a two-way communication channel to a surface system.

The system further includes downhole control systems, such as electronics, valves, packers, pumps, and other systems related to controlling and operating the fluid flow processes.

An essential aspect of the present invention is a sealing device for isolating a production zone intersecting the main wellbore. Dual packers are commonly used in the art to isolate the wellbore from the formation of interest. In one embodiment of the present invention, the isolation packers are inflatable packers. Each inflatable packer will upon inflation provide a pressure tight barrier between the body of the well test system and the wall of the formation of interest. The packer elements are some distance apart, typically 1-2 meters or more. The annular space between the packer elements will be isolated from the annular space above the upper packer and the annular space below the lower packer. The well test system with the fluid inlet and control valve is positioned between the packer elements, thus forcing the flow of formation fluid to enter the well test system between the two packers.

In a preferred embodiment, the well testing system also includes sensing or other measurement means to determine the exact position of the chemical tracer release chambers in each of the sidetracked wellbores. Thereby both the time taken, and the distance travelled from each of the release chambers in each of the sidetracked wellbores will be measured and determined, along with a multiple of other well test parameters such as pressure, temperature, flowrate, fluid viscosity and other parameters referenced above.

One common method to determine the geometric position of a location in a wellbore is to use directional survey instruments. During drilling, a Measurement While Drilling tool including a directional sensor is commonly used. The directional sensor typically includes a tri-axial accelerometer package and a tri-axial magnetometer package, measuring the earth gravitational field and the earth magnetic field respectively. This allows the inclination relative to the earth vertical axis and the direction relative to magnetic North to be measured on each survey station. The depth of performing the directional survey is commonly determined from the total length of drill pipe measured from the surface of the drilling rig.

An alternative to a magnetometer is to use a gyroscopic sensor that measure the earth spin vector, and in combination with an accelerometer package to calculate the directional parameters described above. This is commonly used in situations where there is magnetic interference present, such as in close proximity to other wellbores that has steel component installed.

The position of the directional survey instrument in the wellbore is calculated incrementally by adding the position information from the survey station to that of the previous survey station, thus calculating the position along the wellbore relative to the starting position from the rig surface. The survey information, expressed as x, y and z co-ordinates, may further be linked to a central reference system for the field or area.

Directional survey measurements, like any other measurements, have uncertainties associated. These uncertainties are not constant but vary depending on several factors. One such uncertainty is the measurement from the magnetometer package, that will be more predominant in a North-South direction than in an East-West direction. The uncertainty will also be more predominant at higher wellbore angles, such as drilling horizontally. This is well known in the art. Consequently, the accuracy of the positional data from each survey station will decrease as the distance from the reference point is increasing because as the uncertainty from each survey station is added to that of the previous station. As a result, the uncertainty of a directional positional computation at a depth where well testing is commonly performed could be quite significant, especially in the horizontal plane. Such uncertainties could be in the order of 20-30 meter or more when the surveys are referenced to the rig coordinate system starting at the surface of the rig.

The present invention includes a method of determining the positional data of the chemical tracer material release chambers relative to the position of the intelligent well test system. The purpose is to know the distance the chemical tracer material has travelled through the reservoir from where it was released to where it enters the well test system. By referencing the positional data of the sidetracked wellbores to the positional data of the main wellbore, starting from the position where the sidetrack was initiated, the uncertainty of the position of each said sidetracked wellbore will be greatly reduced. This is especially true for the shorter inline sidetracked wellbores that may start only 30-50 meter above where the well test system is installed and drilled to a position that may be only 10-20 meter away from the said well test system in the horizontal plane. Due to the relatively close proximity between the wellbores where the well test system equipment associated with the present invention, the accuracy of the calculated distance between the said well test system equipment is greatly improved by referencing all wellbores to the same downhole position where the sidetracks are initiated.

An alternative method of estimating the distance between the well test system equipment in the wellbores relative to each other is to use a downhole sensor that can measure the distance to the relevant well test equipment in the adjacent wellbores directly. One such method is to use an electromagnetic wave transmitter and receiver arrangement. Electromagnetic wave technology is commonly used in Measurement While Drilling industry to measure the conductivity of the reservoir, and from this derive the resistivity. An electromagnetic wave is emitted from a transmitter, and the attenuation and the phase shift of the electromagnetic wave is measured, ideally between two receivers. The attenuation is a measure of the dampening of the amplitude of the electromagnetic wave as it travels through the formation, and the phase shift is a measure of the reduction in speed as the electromagnetic wave is slowed down. This is well known in the art.

The present invention includes a method where the signal, such as an electromagnetic wave, is either transmitted from the well test system and received at the one or more isolated drone chemical tracer material release devices, or vice versa, the electromagnetic wave signal is transmitted from each of the said isolated chemical tracer material release devices and received by a central receiver in the main well test system. Each receiver module will ideally include both a near and far receiver, the near being closest to the transmitter and the far being on the opposite side of the receiver module, further away from the transmitter. The phase shift and attenuation are measured between the receiver antennas. Assuming the conductivity is constant between the transmitter and the receiver antennas, the attenuation and phase shift will be directly connected to the distance the signal has travelled from the transmitter and thus the distance between the transmitter and receiver modules.

An electromagnetic wave of a lower frequency travels further and is less dampened and slowed down by the formation than an electromagnetic wave with a higher frequency. This is well known in the art. In a Measurement While Drilling electromagnetic resistivity sensor arrangement the two frequencies of 400 kilohertz (kHz) and 2 megahertz (MHz) are commonly used. Deeper reading resistivity tools where a longer spacing between the transmitter and receiver and a longer wavelength (lower frequency) are used to detect bed boundaries further away from the borehole, such as an oil-water contact or a gas-oil contact. This is well known in the art.

In a preferred embodiment, each isolated drone chemical tracer material chamber release tool in the well test device is equipped with an electromagnetic wave transmitter, later referred to as a lateral transmitter. The sensor module in the well test system is equipped with an electromagnetic wave receiver, later referred to as a lateral receiver, capable of receiving electromagnetic wave signals from the said one or more well test devices. The reduction of amplitude and the phase shift of the signal may be measured by comparing the signal received by two receivers spaced some distance apart. However, as these two receivers will be placed within the same borehole, the distance between the two receivers will be small compared to the distance to the transmitter, thus potentially resulting in inaccuracies in terms of using the measurements to derive the distance to the transmitter and thus the position of the well test devices relative to the well test system.

In another preferred embodiment, the said electromagnetic wave transmitters will transmit electromagnetic wave signals of multiple frequencies. The lower frequency signal with the longer bandwidth will be less dampened and less slowed down than a higher frequency signal. By comparing the signal from two or more frequencies a more precise measurement and thus calculation of the distance between the transmitter and the receiver(s) will be enabled. This is because this arrangement will measure the dampening and phase shift of the said signal along the entire distance travelled, from the transmitter to the receiver(s). As can be understood, only one receiver may be required when two or more frequencies are emitted from the transmitter. Further, as can be understood, each transmitter in each well test device may use a plurality of frequencies, and they may transmit simultaneously, or one at the time.

In the section above, a detailed description was given on how electromagnetic wave technology could be used as part of the lateral transmitter and receiver arrangement to quantify the distance between the well test system where the well test would be performed, and one or more well test devices in one or more additional wellbores where chemical tracer material may be released.

In another embodiment an acoustic signal is used instead of the electromagnetic wave signal. The fundamental aspect of this embodiment is similar to that above. An acoustic wave is emitted by a lateral transmitter and received by a lateral receiver. The dampening of the signal is depending on the formation ability to carry the acoustic wave, and fundamentally also to the distance between the transmitter and receivers. Analog to the discussion of the electromagnetic wave lateral transmitter and receiver, an acoustic wave signal may be used for the same purpose. In a preferred embodiment an acoustic source capable of transmitting an acoustic wave of different frequencies, and an acoustic receiver capable of receiving the acoustic signal at different frequencies is used.

The same lateral transmitter and receiver arrangement as discussed above, using either an electromagnetic wave or an acoustic signal, may be used to transmit commands from the main well test system to the one or more well test devices within the same formation of interest. Commands may be sent using a pre-programmed sequence where the frequencies are changed, and duration of transmitting at a particular frequency is varied according to the said pre-programmed sequence. The electromagnetic wave signal or acoustic signal is received by the lateral transmitter receiver and analysed by the electronics and memory module in the well test device. In a preferred embodiment for bi-lateral communication between a well test system and a well test device, the lateral transmitter is placed in the well test system, which will send the commands, and the lateral receiver is placed in the one or more well test devices, which will receive the commands. One such command would be a command to release chemical tracer material from the chemical tracer material chamber.

In one embodiment, the system includes a solution to drill the one or more sidetracked wellbores from the main production wellbore to the desired location for installation of the chemical material release chambers. The sidetracked wellbores may be a single sidetracked wellbore or, two or more sidetracked wellbores. The sidetracked wellbores may be drilled in a sequence, one after the other, in a different direction and distant to each other. In a preferred embodiment further described in the present invention, multiple sidetracked wellbores are drilled simultaneously from the same location and depth from the main production wellbore. For example, if three sidetracked wellbores were drilled, these would be drilled in three different directions extending out from the main wellbore, ideally about 120 degrees apart, surrounding the main wellbore and allowing information to be determined about the directional permeability and mobility in various directions.

In one embodiment, a primary wellbore is drilled and relevant well test equipment such as a well test device with chemical release material chamber is installed in the said primary wellbore. Subsequently, a new secondary wellbore is sidetracked and drilled in proximity to the primary wellbore. In this process, the primary wellbore may be abandoned where it is no longer possible to physically re-enter this primary wellbore, but it might be possible to communicate with the well test device therein through signals travelling through the earth. This is further described above. Additional isolated, sidetracked wellbores may be drilled and established around the desired location to install the well test system, which may be drilled last and kept open to provide full access and communication to the said well test system. These sidetracked wellbores that are left isolated after they have been installed are later referred to as satellite wellbores and the chemical tracer material devices installed in them are referred to as drones.

Subsequent to installing one or more satellite wellbores around the main wellbore, additional sidetracked wellbores may be established by exiting the said main wellbore above the zone of interest for well testing and drill one or more shorter sidetrack wellbores to penetrate the zone of interest radially around the main wellbore. These shorter sidetrack wellbores may be kept open during the well test and be in communication with the well test system in the main wellbore. Such wellbores are later referred to as online wellbores and the chemical tracer material devices installed in them are referred to as online chemical tracer release modules.

The invention presents a solution whereby one or more satellite wellbores may be established first. These can be significant distance from the main wellbore, but still penetrating the subsurface formation of interest. Subsequently, a main wellbore for well testing is established, with or without one or more online wellbores. Further description of how the multiple wellbores is drilled and established, in series or simultaneously, is found below.

Each sidetrack drill string may contain one or more chemical tracers. These tracers may be stored in individual chambers, and each chamber can be opened individually to release the chemical tracer material on command. The chemical tracer material may be placed in dedicated subs that are part of the sidetrack drill strings, in close proximity to the drill bits, or in one or more chemical tracer release chamber subs along the sidetrack drill strings. Furthermore, the sidetrack drill bits may contain the one or more chemical tracer release chambers themselves, for instance in the blades of the said drill bits, or in stabilizers that are part of the sidetrack drill string. Finally, the chemical tracer material may be stored in the flow distribution tool above the sidetrack drill strings, or in proximity thereof. In this configuration, the chemical tracer material will be pumped down each individual sidetrack drillstring and will exit through the drill bits at the lower end.

In one aspect of the present invention, the chemical tracer material is in fluid form in a chamber within the well test device and is released to the wellbore by pumping out the material using a downhole pump. In another embodiment the chamber with the chemical tracer material is pressurized with a pressure higher than that of the wellbore pressure, and the chemical tracer material will exert into the wellbore when the release port is opened. In another embodiment, the chemical tracer material will be contained in small capsules that are released to the wellbore. If the pressure within the capsule is higher than the pressure in the wellbore it will instantly explode when released, and if the pressure within the capsule is lower than the pressure in the wellbore it will instantly implode when released. In both cases the capsules themselves will instantly decompose and the chemical tracer material is released to the wellbore.

Regardless of the method used to release the chemical tracer material to the wellbore, a confirmation of the time of the release is recorded by the electronics and memory module of the well test device. This time and thus a confirmation that the chemical tracer material was released is transmitted to the well test control system. The primary means of communication is to use a digital signal through the wired drill strings or wired coil tubing strings that connects the well test device and the well test control system. This is described as an axial transmitter and receiver within the intelligent well test system. When an isolated drone well test device is used, this is not physically connected to the well test control system. In this case, the information and time of released of a chemical tracer material is either transmitted to the well test control system via the well test system by the means of a signal travelling through the subsurface formation of interest, such as an electromagnetic wave or and acoustic wave, previously described and referred to as a lateral transmitter and receiver. Alternatively, the information is transmitted uphole to the well test control system by a signal travelling through the earth, such as an electromagnetic wave, or through the well bore, such as pressure pulses within the drilling mud. Both these methods are features of the axial transmitter and receiver arrangement.

The method of transmitting information by the use of pressure waves through the drilling mud is widely used in the Measurement While Drilling industry. The Measurement While Drilling tool will include a pulser assembly, such as a piston, orifice, or restrictor. Upon activation of the pulser, the flow of drilling mud past the pulser will be restricted and will cause the pressure to increase. This is known in the art as positive pressure pulses. The pressure increase will travel uphole inside the drill string to the drilling rig where a sensor is constantly measuring the pressure. The pressure signal is decoded and the date from the downhole tool is registered. An alternative to the positive pressure pulses created by the piston or restrictor arrangement, is a negative pressure pulse generated by the opening and closing of a downhole port to bypass parts of the mud flow into the annulus.

In the present invention, a pressure transmitter arrangement may be used to transmit data axially, either from a well test control system to surface, or from the well test system to the said well test control system, or from a well test device such as a drills string with connected well test device to the said well test control system.

Another known prior art is the ability to transmit data from the surface rig down to the Measurement While Drilling tool, or other drilling systems. One known method is to use the mud pumps to vary the flow rate in a predetermined sequence. In doing so, the voltage output form the turbine/generator arrangement, if used in the Measurement While Drilling tool, is varied accordingly, and this is decoded as a command received from surface. Such variations can be achieved by varying the mud pump output or by using a bypass arrangement in the surface mud flow piping system to vary the flow rate accordingly. When varying the flow rate, the pressure travelling down the drill pipe will vary accordingly, enabling an alternative method of sensing the data signal as a pressure variation representing the command sent downhole from surface.

The same method as described above may be used to send commands from the surface down to the well test control system in the present invention, as part of the two-way axial transmitter and receiver arrangement. Similarly, the same technology may be used to send commands from the well test control system further down to the well test system below, or from the well test control system to a drill string with connected well test device. The primary means of axial communication between the well test control system and the well test system, and/or the drill string(s) with connected well test device is through a wired sidetrack or a wired coil tubing or a wired connection pipe. The use of a two-way axial transmitter and receiver arrangement using pressure signals in the drilling mud is thus an optional method.

The sidetracked wellbores may further be instrumented and include sensors and measurement technology. These instrumented devices may be an integral part of the sidetrack drill string, like the chemical tracer release chambers, or it may even be the same device providing multiple functions. In one embodiment, these devices are battery operated, include a synchronized clock and one or more sensors, a memory, and an electronics unit. The said measurement device may be an integral part of, or connected to, the one or more chemical tracer release chambers. A preferred sensor to have as part of the sidetrack wellbore instrumentation is a pressure sensor. One fundamental aspect of the invention as discussed elsewhere is to release chemical tracer material in a controlled way, and to measure the time, distance, and direction for the chemical tracer material to reach the detection point within the well test system. This will provide new and valuable information about the directional permeability and the directional mobility of the reservoir rock.

Additionally, measuring the pressure in the sidetrack wellbores will also provide information about how quickly the pressure drawdown is reaching each individual wellbore and location within the reservoir. Traditional well testing theory and reservoir analysis methods commonly assume that the formation fluids are flowing radially towards the wellbore during production. Anomalies in the reservoir may render such assumption to be false. The same anomalies may be observed as directional variances in the permeability and mobility, which may be revealed by observing the time from the draw-down is initiated until this is registered by the pressure sensor in each individual measurement module within the sidetracked wellbores. As can be understood, the distance from each sidetracked wellbore, and thus the pressure sensor, may be different for each sensor. This difference in distance can be accounted for using the same radial flow model, and any anomalies in the results that are detected may contribute to greater understanding of the downhole reservoir and the flow characteristics therethrough. The sensor module in the individual sidetracked wellbores may also include other sensors, such as temperature.

In one embodiment the sensor module is battery operated and includes a synchronized clock and a downhole memory. All data pertaining to the sensor module is continuously measured and stored in the module memory. This may also include registrations of when the chemical tracer material port or ports was opened or closed, or even control mechanisms to initiate the said opening or closing of the said chemical tracer material release chambers. Upon retrieving the well test tool string, the memory of these measurement modules may be retrieved to obtain all data logged in the sidetracked wellbores during the well test. In one aspect of the invention, the instrument such as the isolated drone chemical release module is left in the well at the formation of interest, without physically being connected to the rest of the well testing system. Communication with the isolated drone may be achieved through aforementioned methods such as pressure signals travelling down the wellbore, or by signals travelling through the earth, from above, such as a seismic signal using sound waves, or from the intelligent well testing system installed laterally in the same formation of interest. Data from the isolated drone may be transmitted through the earth to the intelligent well testing system by the same means, or in case of an isolated drone being permanently installed in the wellbore, the data may be transmitted to surface by a wired pipe or tubing, or by periodically releasing information capsules that will float to the surface where it is collected and registered. This communication method is further described in patent U.S. Pat. No. 6,745,833 (Aronstam/Berger). The method described uses flowable devices in wellbores. This solution is particularly relevant for an isolated drone that is installed permanently as part of a field development.

In the present invention, a flowable device may be used to transmit data from the well test device to surface. A flowable device may be ejected from the well test device and float to surface by buoyancy as it is lighter than the fluid in the wellbore, such as the drilling mud. At surface, the flowable device is collected and the data from its memory is read and registered. This method may be used to periodically transmit data from an isolated drone well test device that is installed permanently as part of a field development solution. This method may also be used to transmit data from an isolated drone well test device to a well test control system installed above during a well test.

In a preferred embodiment the invention furthermore includes systems to perform the production test without producing the fluids to surface. This may be achieved by enabling the production of the reservoir fluids to be collected in one or more sample chambers. Another alternative is to allow the produced reservoir fluid to be re-injected in another adjacent and suitable downhole formation.

FIG. 2 illustrates the general arrangement of injecting produced fluids into an adjacent permeable zone. This method is further described in patent U.S. Pat. No. 6,305,470 (Woie) Method and apparatus for production testing involving first and second permeable formations.

The predominant way of conducting a formation production test will be to allow the reservoir fluid to flow into the main production wellbore and either be conveyed to the surface of the well, or into a collection chamber, or released to the annulus as with FTWD technology, or re-injected into an adjacent formation as described above. In all these scenarios the reservoir fluid will flow through the formations towards the main production wellbore and as the reservoir fluid is passing the sidetracked wellbores the chemical tracer material is released and will flow towards the main production wellbore with the reservoir fluid. However, it may also be relevant to carry out a reverse test where the fluid is re-injected into the production zone from the main production well and a reverse fluid flow established where the reservoir fluid will flow towards and into the sidetracked wellbores.

The above principle of reverse production testing may include the principle of maintaining a flow channel or communication path from the bottom of the sidetracked wellbores up to and into the main wellbore after the drilling of the sidetracked wellbores. This may be achieved by drilling these sidetracked wellbores with individual drill strings or tubing from the main wellbore and leaving these individual drill strings or tubing intact after the sidetrack drilling has been completed, thus facilitating communication from the bottom of the sidetracked wells into the main wellbore through the drilled path. This communication channel, or channels, may be used in different ways. First and foremost, it may be used to pump the chemical tracers from a main reservoir and pumping system in the main wellbore, as previously described, down through the sidetracked wellbores and subsequently placed in the bottom or lower part of the sidetracked wellbores where it may be released into the formation. Individual chemical tracers with unique characteristics may be used for each sidetracked wellbore. The chemical tracers may be placed at its intended position and from there released and carried into the reservoir by the reservoir fluid that is flowing during a well test. Alternatively, the annular space between the drill string or tubing in the sidetracked wellbore may be closed, thus preventing the circulation of fluid down through said drill string or tubing to be returned to the main wellbore, and as is known in the art, the fluid will then be pumped into or injected into the reservoir. By maintaining the pump pressure, a different mode of production testing is established, where the fluid from the sidetracked wellbores is pumped into the formation by applying additional hydraulic force, rather than being sucked into the formation by the pressure differential between the production wellbore and the sidetracked wellbore.

To complete the description of the utilization of the sidetracked wellbores, and assuming the communication channel between the lower part and the main wellbore is intact, a well test may be conducted where the fluid is flowing from the production wellbore, through the formation and into the sidetracked wellbores. From the sidetracked wellbores it is further allowed to flow up through the said communication channels represented by the sidetracked drill string, or other, and into the main wellbore, either for production to surface, collection into a sample chamber or for injection into an adjacent formation. In other words, what is described is a production test performed in the reverse direction, such as potentially also performed during an injection test.

Drilling of a sidetrack from a main or first wellbore is commonly used for several reasons. One such reason may be to overcome a technical problem that have occurred during drilling of the original wellbore. Equipment may get stuck or other factors may render the original wellbore useless. Drilling of a sidetrack to pass the problem zone is a common way of solving such problems, rather than drilling a completely new well. A sidetrack may also be drilled for geological reasons, for example to explore the reservoir properties, such as locating an oil-water contact. However, in relation to the present innovation, one or more sidetracked wellbores are intentionally drilled from a main wellbore to establish a network of interconnected well paths from the main wellbore. The purpose is as previously described to use controlled release of chemical tracers as part of a production or injection test to measure and quantify key reservoir parameters more precisely.

Several methods exist for drilling a sidetracked wellbore from another wellbore. One such method is to set a cement plug in the original wellbore at the depth where the sidetrack is intended and then to use a directional drilling tool and orient this in the desired direction for the sidetrack, followed by controlled drilling in this direction. This method is commonly used in an open hole sidetrack. The firm cement plug is then used to push the bit into a less firm formation, thus establishing a new path where the sidetracked wellbore is drilled. Another similar method is to install a tool commonly referred to as a whipstock, where this is oriented and anchored in place in the original wellbore, and where the whipstock has an opening in the side where the sidetrack is intended to be performed. This method is commonly used in a cased hole sidetrack. Both these techniques have the disadvantages of only being able to drill one sidetrack at the time, and they will block the assess to the main wellbore unless the cement plug or the whipstock are removed from the wellbore.

The present invention comprises a method of using a whipstock, where multiple sidetracks may be drilled simultaneously, as well as retaining access to the main original wellbore. This is achieved by first drilling a main wellbore with conventional drilling techniques, then subsequently running in with a well test tool string into the said main wellbore, equipped with the sidetrack drilling means above the well test tool string, setting or anchoring a single- or multi-lateral whipstock at the desired depth and subsequently drilling the one or more sidetracked wellbores out through the formation surrounding the main wellbore and into the reservoir zone where the well test is intended.

A novel solution is presented, where multiple sidetracked wellbores are drilled simultaneously from the main wellbore. A whipstock is known in the art as a means of initiating a sidetrack from one wellbore to deviate and drill a new wellbore in a different direction. Such whipstock may be oriented using a directional survey instrument, such as a Measurement While Drilling (MWD) tool, to set the exit ramp of the whipstock so the drilling of the new hole to be initiated in the desired direction. The drilling of the sidetracked wellbore may then continue along a pre-planned direction, commonly executed with directional drilling tools such as a rotary steerable system or a steerable mud motor, the latter typically known in the art as a Positive Displacement Motor (PDM). The directional properties of the new, sidetracked wellbore may then be measured at survey stations along the new sidetracked wellbore using the said MWD tool. In the present invention, multiple sidetracks may be drilled simultaneously, for example three sidetracks drilled about 120 degrees apart, radially relative to the main wellbore. The initial orientation of the radial whipstock may or may not be measured and directionally controlled prior to positioning the whipstock at the desired depth. Commonly in the art, the whipstock may be set on top of a cement plug in a previously drilled wellbore, or it may be set using a packer element to keep it from moving down or rotating when subject to the forces of drilling.

In the present invention, the radial whipstock may be an integral part of the well testing tool and run into the hole as part of the well testing assembly. The inflatable packers of the well testing tool may be used to lock the assembly in place and prevent it from rotating or moving, as the process of drilling the sidetracked wellbore commence. Alternatively, one or more additional and separate inflatable packers may be used in close proximity to the radial whipstock, either below or above the assembly.

As can be understood, the radial whipstock and sidetrack assembly may be run independent of the well testing assembly. Nevertheless, the pre-orientation of the radial whipstock may not be required, as it may not be critical which of the multiple wellbores are drilled in what direction. Should this be a critical factor, for instance if only one or two sidetracked laterals are to be drilled, common survey and orientation techniques may be used, as previously referred to. It should also be noted that although the radial whipstock and its multi ramp exit system ideally is placed at the same point of the main wellbore assembly, thus allowing the radial sidetracks to be drilled from the same depth, it may, due to design considerations be necessary to space the exit ramps some distance apart along the sidetrack tool string. The purpose is nevertheless to allow the sidetracks with the chemical tracer material to be drilled and placed radially around the main wellbore, each intersecting the zone of interest for well testing, and each having its directional properties determined to provide accurate distance and direction in three dimensions of the chemical tracer release chambers relative to the main wellbore production system and chemical tracer detection point.

Moreover, a sidetrack drilling assembly and method is presented where a radial whipstock is positioned and locked in place, including one or more PDM mud motor drill strings capable of simultaneously drilling one or more radial sidetracks. In the continued description, a method and apparatus of simultaneously drilling three sidetracks is presented in more detail. This apparatus will have a radial whipstock with three exit ramps about 120 degrees apart. These exit ramps may be at the same depth or axially separated by a minimum distance to allow space for deflection and ramp mechanisms. Behind each exit ramp there is a short sidetrack drill string consisting of a drill bit, potentially one or more chemical release chambers, a PDM mud motor assembly and drill pipe to the upper end. The upper end of the three drill strings will be connected to a drilling mud distributor assembly. The drilling mud distributor assembly will be able to distribute the total drilling mud flow pumped from the surface through the drill string to provide mud flow and hydraulic power to each of the three sidetrack drill strings simultaneously. In an ideal case, the total mud flow will be distributed evenly between the three drill strings, providing equal hydraulic power to each of the PDM motor assemblies.

However, drilling in three different directions may require different force and energy as the formations may have variable drill-ability due to local anomalies. Therefore, the flow distributor may also include adjustable valves to allow the flow to each of the PDM mud motors and sidetrack drill strings to be adjusted individually. Such adjustable flow mechanism may use electrically controlled valves, or other means of adjusting the valve openings individually, or alternatively use the pressure drop across each of the sidetrack drill strings to adjust the flow individually to provide more power to the drill string and PDM that is drilling slower. Another mechanism is described to provide weight to the drill strings. Again, it is possible to use the hydraulic power of the mud flow from surface to put pressure on a piston that will provide a hydraulic force to fundamentally pump the said drill strings down and outward, while drilling the sidetracks simultaneously. This is later referred to as a weight-on-bit tool (WOB). In one embodiment a wired sidetrack drill string is used between the mud motor drilling assembly below and the drilling mud distributor above. A drill string has sufficient axial compressional strength to allow the weight transfer to the mud motor and drill bit to be achieved by a compressing force applied from above. In another embodiment a wired sidetrack coil tubing is used, which does not have sufficient axial compressional strength and thus a wired weight-on-bit tool may be used between the wired sidetrack coil tubing and the wired mud motor to provide a downhole force to the mud motor and drill bit.

In a preferred embodiment the said one or several sidetrack drill-strings is kept intact in the said sidetracked wellbores after completion of the drilling process, thus providing communication channels from the bottom of the sidetracked wellbores into the main wellbore. The chemical tracer material may then subsequently be placed in the bottom of the one or more sidetracked wellbores by simply pumping it down through the individual drill-strings. Alternatively, the said sidetrack drill strings may be equipped with one or more chemical tracer release modules where the chemical tracer material is released upon activation. This activation may either be a signal transmitted axially through the drill-string, such as an electrical signal through a wired coil-tubing or a wired drill-string, or a fluid conveyed signal through the inside of the drill-string or the outside annulus surrounding the drill-string, such as pressure or flow pulses through drill fluids inside or outside of the drill-sting. Alternatively, the signal may be transmitted laterally from the main production well test system through the formation between the said main wellbore and to the sidetracked wellbores, by means of electromagnetic or acoustic waves transmitted through the earth. In another configuration of the well test system, the release of the chemical tracers may be controlled by a pre-programmed sequence and activated for instance by a timer instead of transmitting a signal.

In another embodiment, the drill-strings used to drill the sidetracks may be pulled out or retracted after drilling of the sidetracks. Subsequently one or more chemical tracer release modules may be installed in each of the sidetracked wellbores. The same activation means, by transmitting a signal laterally through the formation from the main wellbore to the sidetracked wellbores, may also be used to activate the one or more chemical release modules in the said one or more sidetracked wellbores. As can be understood, each individual release module may be activated or deactivated independent of the other release modules. Furthermore, each sidetracked wellbore may include several chemical tracer material release chambers at different positions along the sidetracked wellbore, potentially intersection different layers in a multi-layer reservoir. Furthermore, each chemical release module may contain a plurality of individual chemical tracers, thus enabling a plurality of options for individual release of individual chemical tracer material.

It may be desired to be able to repeat the process of releasing the chemical tracer material multiple times, which would require controlled opening and closing of each individual sample chamber or the ability to release chemical tracer material with different characteristics from different sample chambers. One such application is to monitor the performance of various well stimulation tests. For instance, if a reservoir sone of interest is stimulated with acid treatment, or hydraulic fracturing, repeating a directional permeability test after the treatment is performed will directly offer permeability and mobility results before and after stimulation. As can be understood, these processes may be repeated several times to test the results of various well stimulation techniques, or various tests of the same well stimulation technique, such as acid treatment with different compositions or concentrations.

The precise location of each chemical release module is essential to perform detailed analysis of the formation and reservoir characteristics, such as the permeability in a certain direction. Several methods may be used to determine the location of the chemical tracer release modules. One such method is to use directional measurement sensors to monitor the length and direction of the drilled sidetracked wellbores relative to the main wellbore. By measuring the length of the drill pipe or tubing that is used to drill each sidetracked wellbore and the inclination and direction of the sidetrack drill bit, the location of each chemical tracer release module can be calculated individually. One alternative method is to measure the distance and direction of the sidetracked wellbores by sending a signal from the sidetracked wellbores to the main wellbore, or the other way around. This signal may be an electromagnetic wave or other low frequency signal capable of travelling the required distance through the rock. The attenuation of an electromagnetic wave will for instance depend on the distance from the transmitter to the receiver. Another potential signal source may be an acoustic signal. In another embodiment a method referred to as magnetic ranging can be used, where the proximity to a nearby magnetic component such as a steel drill bit may be measured using either active magnetic ranging, where an artificial magnetic field is generated and used as part of the measurement technique, or passive magnetic ranging where the distortion of the earth magnetic field caused by the inherent magnetism of the components in the sidetracked wellbores is used as the signal source. The details of the methods of communication between different wellbores within the same formation of interest is discussed in more details in a previous chapter.

Finally, upon completion of the production test of the zone of interest, the individual sidetrack drill strings may be retracted from the sidetracked wellbores by reversing the mud flow of the assembly that was used to pump weight to the drill strings to instead lift the plurality of drill strings into the main assembly. The entire operation may be repeated at another depth and another zone of interest for well testing, or the entire drilling and testing assembly is retrieved from the wellbore.

In another embodiment, the drill-string used to drill the one or more sidetracked wellbores is pulled out after the sidetrack wellbores are drilled, and prior to pulling the drill-string out, one or more samples of the specific chemical tracer material is simply spotted at the bottom of the sidetracked wellbores, with no need for controlling the release of the chemical tracer material. This has the advantage of being a simpler solution, but the disadvantage of not being able to control the release of the chemical tracer material. In this case, the chemical tracer material is already exposed to the reservoir, and as soon as the production test system is activated and reservoir fluid starts flowing towards the main wellbore, the chemical tracer material will also start flowing in the same direction. Ideally, the well and the formations close to the test module is cleaned up first by allowing initial production into the well test system to remove drilling fluids that have invaded the formations during the drilling process. Subsequently, after the clean-up phase, the well will be shut in to reach pressure equilibrium, and then the primary drawdown test will be started, and it is in this phase, after the well is flowing at a constant rate, that the chemical tracer material is released. Therefore, a chamber and mechanism where the release of the chemical tracer material can be controlled is desired, rather that placing the chemical tracer material in the bottom of the sidetracked wellbore without shielding it from the surrounding formations and reservoir fluids. However, if this simpler solution is used, the chemical tracer material placed in the bottom of the sidetracked wellbore may be in fluid form, and of similar viscosity as the formation fluid, thereby immediately respond to the pressure drawdown once the drawdown test starts, or it may be in solid form, as small pellets placed in the bottom of the sidetracked wellbores and be gradually released as the chemical tracer pellets dissolves.

An important aspect of the present innovation is the ability to perform downhole measurements that will be recorded for later analysis, and/or to the extent possible, be transmitted to surface for real-time analysis and control of the well test process.

These sensors and downhole measurements may be used to monitor a variety of aspects relating to the downhole well test results and conditions. Fundamental measurements such as pressure, temperature and produced or injected volumes will be recorded by pressure sensors, temperature sensors and volumetric sensors, respectively. The sensors may be placed on the outside of the well test control valve, relative to the fluid inlet of the well test system, for measuring these parameters of the fluids that are entering the well testing system in production mode, or on the inside of the well test fluid inlet and control valve for measuring the same parameters internal to the well test system. As can be understood, in the case of the well test tool is used for injection rather than production, and the same sensors may be used relative to the injection process. The pressure, volume and temperature data are essential to analyze the reservoir including the reservoir fluid and its properties, commonly known as PVT (Pressure, Volume and Temperature) analysis.

Other sensors may be included to provide diagnostics data and control the operation of the well test tool. Such sensors and diagnostic data may include, but not be limited to pressure inside packer elements to monitor their performance, setting of the fluid inlet and control valve to verify its current position as opened, partly opened, or closed, pressure differential across the internal pump and pump speed of the same, self-check and system diagnostics sensors.

In the preferred embodiment the fluid inlet and control valve are electrically operated and controlled by the well test system electronics and memory module. The control valve may have several settings, from fully closed to fully opened, and with one or more intermediate settings. The operation of the control valve may be through an electrical motor that uses a worm gear to move a piston that will move the control valve to the desired position.

Furthermore, a sensor such as a fluid analyzer, may be included to measure and determine the chemical composition of the produced fluids and thus provide critical information of the reservoir fluid. By transmitting key parameters to the surface in real-time, the well test operator can monitor the production process and for instance verify when the near-wellbore fluids from the drilling process have been cleaned out and only pure reservoir fluid is entering the system. This information is very useful in determining when the formation is clean and ready for the main drawdown/buildup test, and when a clean fluid sample may be collected. Furthermore, the chemical composition sensor device may be used to register the presence of the one or more chemical tracer components. To determine the time and distance travelled by each individual chemical tracer material, it is essential to precisely register the presence and composition of the chemical tracer material and the time it is entering the well test system. A sensor is included in the system, tailored to register the chemical tracer material quickly and precisely upon entry into the well test system. Each sidetracked wellbore may have one or more chemical tracer material components, each with a distinct signature and different from any other chemical tracer material.

By controlling the time of release of each chemical tracer material from the individual sidetracked wellbores, the time of registering of the same chemical tracer material into the well test system, and knowing the distance, direction, and relative position in three dimensions of the release point relative to the well test system opening, the directional permeability may be precisely calculated. Furthermore, by measuring the fluid viscosity, which may also be done by the fluid analyzer, the directional mobility is also calculated. Such method of determining directional permeability and/or directional mobility through direct measurements is a new and innovative approach, and one of the main objectives of the present invention.

The concept of real-time two-way communication with the downhole well test system has been previously mentioned. Such real-time two-way communication systems are commonly used in the drilling process, known in the art as Measurement While Drilling (MWD) systems or Logging While Drilling (LWD) systems. These systems are described as a tool including a power source, such as a turbine and generator or a battery, one or more sensors that measure various characteristics of the tool, of the borehole or of the surrounding formations, a downhole electronics unit for controlling the system and processing data, and a communication system for transmitting information to surface through various methods such as pressure pulses in the drilling fluid inside the drillstring, signal transmitted through the drill string itself or a wire connected to or integrated in the drillstring, or even through the earth itself using long band—with electromagnetic waves. The system may also receive information from the surface, through either pressure signals or flow rate signals or any of the other aforementioned communication channels. Such information transmitted downhole to the MWD or LWD systems is normally performed to communicate a command to the downhole tools, such as initiating a specific process, or adjusting settings of downhole tools, such as an automated directional drilling tool that is programmed to receive new target information.

The present invention will utilize two-way communication with the downhole intelligent well test system for several reasons. First, commands or information may periodically be transmitted from surface to the downhole tool. This information is mainly sent to the downhole tool to change the settings or initiate a change or an operation. This could be a command to change the setting of the production choke, or to initiate a process of inflating or deflating the packer elements, or to send a command to release chemical tracer material from the one or more chemical tracer material release chambers, or to open or close a sample chamber for collecting a fluid sample, to name a few. Furthermore, information from the downhole system will be periodically or continuously transmitted to the surface to provide information on the system settings, diagnostics, and self-checks, including but not limited to, confirmation that a command sent from surface is received by the tool. This will enable the operator to verify the tool operation and the formation testing process. Data received on surface may also be used to perform preliminary analysis of the performance of the downhole production test, or information obtained from the same. This data, such as pressure, volume, and temperature data, may be used to estimate the extent and volume of the reservoir. More specifically, the pressure data from the drawdown test or the buildup test will be continuously monitored to watch for indications of bed boundaries or other indications that the limits of the reservoir have been mapped and subsequently the next test of the intended test program may be initiated.

More specifically, and related to the present invention, information from the downhole fluid analyzer will be transmitted to the surface in near real-time, enabling the operator to verify when the formations surrounding the borehole have been cleaned up from drilling fluid contamination, and particularly when the chemical material from the one or more chemical release chambers is entering the system. This information, together with the exact position in 3D of each individual chemical material release chamber, will be used to determine the directional permeability in the reservoir. If the sidetracked wellbore(s) where the chemical material is released intersect more than one layer of formation, then the directional permeability of each intersected layer may be determined independently, by repeating the production test procedure in each of the layers.

An essential purpose of well testing is to obtain clean fluid samples from the downhole reservoir, preferably sampled at in-situ conditions. One drawback with conventional well testing (DST) is that the fluid samples are collected on surface, at different pressure and temperature than the downhole conditions. The formation fluid has therefore already been subject to a pressure and temperature decrease and consequently undergone some form of transition from its original fluid form when in the reservoir. Such transitions can vary greatly, depending on the fluid composition and the reservoir conditions. Gas that may be dissolved in the oil when in the reservoir may undergo a transition from liquid to gas form during the move to the surface, greatly disturbing any PVT related conditions, and thus making it difficult to perform exact modelling of the fluid under reservoir conditions. A variety of other transitions may occur, demonstrating the need to collect the fluid samples at reservoir conditions, and keeping the fluid samples contained until they can be brought into a laboratory and where a PVT analysis and other relevant tests may be performed under controlled conditions.

Other downhole well testing methods, such as wireline operated, or LWD formation tester can collect a fluid sample at reservoir conditions. However, because their volumes are typically very small, there is a risk that the fluid sample is not clean if too little formation fluid has been drained from the reservoir to properly clean up the formations surrounding the test probe from drilling fluid contamination.

These shortcomings of current available technology are solved with the present invention. One or more large sample chambers capable of collecting fluid samples of substantial volume are provided by the system. The opening and closing of the individual sample chambers may be controlled from surface through the previously mentioned two-way communication system. Fluid sampling may be done individually and separately in each fluid sample chamber, or the sampling may be done continuously by sequentially filling up each of the multiple sample chambers. Once a particular sample chamber is full, the valve may be closed, and a pristine fluid sample collected at in-situ conditions later brought to the surface to the rig and eventually into a laboratory for testing.

Various methods for producing the reservoir fluids have been discussed. One method, commonly referred to as Drill Stem Testing, would include a production string being temporary installed for the duration of the test, and producing the reservoir fluids to surface, where it is lightly treated and the hydrocarbons burned off, as with conventional DST testing. This method is well known in the industry and not described further.

One alternative method, although a more recent invention and not as widely used as DST, is the aforementioned Formation Testing While Tripping method. Here typically a wireline or LWD operated formation tester tool is used to establish communication with the reservoir by means of a test module situated between two packer elements, where the reservoir fluid is subsequently pumped from the formation of interest and diverted into the annular space above the packers where it is allowed to dissolve into the drilling mud that is filling up the annular space. As the fluids drained from the reservoir is typically lighter than the drilling mud in the annulus, the reservoir fluid tends to migrate upwards to the surface, and in doing so will be subject to decreasing pressure and consequently expand or even undergo a transition from fluid to gas form where expansion will be more dramatic. Nevertheless, the fluids originating from the reservoir will be received and treated on surface through the mud treatment system onboard the drilling unit. The same production methodology may be used with the present invention, allowing produced fluid to be diverted to the annular space above the test tool and migrate to surface where it is treated.

In another embodiment, the present invention will as said include one or more sample chambers where fluid samples from the reservoir is collected. The sample chambers will be interconnected through a series of pipes and valves, allowing each sample chamber to be opened and closed individually, thus allowing fluid samples to be collected one at the time, or continuously in series. The sample chambers, when closed, will provide a sealed sample of the reservoir fluid, collected under in situ conditions. For safety and handling considerations, the sample chambers should not be longer than traditional drill pipe, typically about 9-10 meters, or any other length that may be laid down on the drill floor in a safe manner while maintaining the integrity of the sample chambers under pressure. In theory, a large number of sample chambers may be interconnected, only limited by the total length of pipe from the rig down to the well test tool.

In one embodiment, the concept of large sample chambers and the ability to divert produced fluid into the annular space is combined. This allows initial volumes of contaminated reservoir fluid to be diverted into the annulus and subsequently clean fluid samples to be collected in the sample chambers. In another embodiment, the produced fluids are re-injected into an adjacent zone downhole. This method is further described in the patent U.S. Pat. No. 6,305,470 (Woie), which is a method and apparatus for production testing involving first and second permeable formations.

In this configuration, a downhole pump is used to pump the reservoir fluids from the zone of interest during the draw-down test, and subsequently inject it into another zone. The two zones are both isolated with inflatable packers. In one embodiment a mud motor (PDM) placed above the well test string is used as a power source and is driven by the mud pumps on surface. Another PDM is used as an injection pump and placed between the production and the injection zone. The two PDMs will be connected through a drive shaft, and when pumping drilling mud from surface, this will cause the upper motor to rotate, which powers the drive shaft, which in turn powers the other PDM used as a pump. This causes the fluids to be produced from the zone of interest and injected into the waste zone. The pressure, temperature and flow rates are monitored. The rotational speed of the interconnected drive shaft can be measured precisely by using a downhole sensor such as a magnet, and consequently the speed of the PDM pump section is known. Furthermore, by knowing the pump efficiency under various conditions and fluids, and by knowing the fluid type and composition from the downhole fluid analyzer, a precise measurement of the pump rate and hence the produced volumes and injection flowrate is obtained. One disadvantage of this design is that it does require a nearby permeable zone that may be used as an injection zone. Another disadvantage is the utilization of the PDM technology as both the driving motor and as an injection pump, since this may cause pressure variations that will be seen as noise when measuring the reservoir pressure.

Reservoir pressure measurements need to be very precise during a production test and it may be challenging to filter out all the noise resulting from pressure variations with the PDM motor and pump. It should be mentioned that other pump types may provide better results. For instance, an electrically driven pump, known in the art as Electrical Submersible Pumping (ESP) systems, may be used. This will require an electrical cable from surface, as part of the well test system, but has the advantage of producing less pressure noise.

In a preferred embodiment, the concept of large sample chambers is combined with the concept of a downhole pump. In this configuration, the well test is conducted by sequentially opening the sample chambers and allowing the drawdown test to be done with production into the sample chambers only, preferably after the initial drawdown and clean-up has occurred, where this initial productions diverted into the annulus. The downhole pump is not used during the drawdown test, which eliminates the pressure noise problem. Subsequently, upon completion of the draw-down test, the well test valve is closed, and the pressure build-up test is performed. Finally, once both the drawdown and the build-up tests are completed, the pump system, being mud pump driven or electrically driven, is used to pump and inject the produced fluid, or parts thereof, back into the same zone where it was produced. Monitoring the results of this process is of interest as it in fact will be an injectivity test of the same reservoir where the productivity test was previously performed. This method solves two fundamental problems in that there will be no pumping during the draw-down test, which eliminates the pump noise issue. Furthermore, it also eliminates the need for a separate, permeable injection zone. It may not be required to re-inject the produced fluid as it may be possible to collect and preserve all the collected samples. However, it may be desirable to re-inject most of the produced fluid and only keep the samples of interest, which will also allow the sample chambers to be reused on another well test. In this way, since all the produced fluids may be temporary or permanently stored downhole, the need to produce these fluids to surface or into the annulus above the well test system is eliminated, and there will be now release of or flaring of hydrocarbons.

The present invention is described by a method for characterizing reservoir properties when producing formation fluids from a subsurface formation comprising:

establishing a primary wellbore intersecting the subsurface formation, establishing a secondary wellbore intersecting the same subsurface formation as the primary wellbore, where the secondary wellbore is sidetracked from, or drilled in proximity to, said primary wellbore, installing one or more well test devices in a selected annular space in either the primary wellbore or the secondary wellbore, and isolating the selected annular space by means of an isolation packer arrangement, installing a well test system in a selected annular space in the other either primary wellbore or secondary wellbore, and isolating the selected annular space by means of an isolation packer arrangement, the well test system is connected to a control system attached to a test string, establishing a fluid communication path from said subsurface formation to the well test system, and letting formation fluids from the subsurface formation flow into the selected annular space and measuring and monitoring at least flow rate and pressure properties of the said flowing formation fluids by means of the well test system, activating the one or more well test devices and measuring and monitoring additional properties of the formation fluids and the subsurface formation located between the primary wellbore and the secondary wellbore, by means of the well test system.

Further features of the inventive method are defined in the claims.

The present invention is also defined by an apparatus for characterizing reservoir properties when producing formation fluids from a subsurface formation, comprising:

a primary wellbore intersecting the subsurface formation, a secondary wellbore intersecting the same subsurface formation as the primary wellbore, where the secondary wellbore is sidetracked from, or drilled in proximity to, said primary wellbore, one or more well test devices that is installed in a selected annular space in either the primary wellbore or the secondary wellbore, the selected annular space is isolated by means of an isolation packer arrangement, a well test system that is installed in a selected annular space in the other either primary wellbore or secondary wellbore, the selected annular space is isolated by means of an isolation packer arrangement, the well test system is connected to a control system attached to a test string, a fluid communication path that is established from said subsurface formation to the well test system for letting formation fluids from the subsurface formation flow into the selected annular space, and where the well test system comprises means for measuring and monitoring at least flow rate and pressure properties of the said flowing formation fluids, activation means for activating the one or more well test devices, and where the well test system is adapted for measuring and monitoring additional properties of the formation fluids and the formation located between the primary wellbore and the secondary wellbore when the one or more well test devices are activated.

Further features of the apparatus are defined in the claims.

The invention allows production testing of a formation of interest while releasing chemical tracer material in one or more adjacent wellbores, registering time and travel distance for the chemical tracer material along with other key parameters related to the well test and using this information to determine key characteristics of the formation of interest such as permeability and mobility in the direction of travel of the said chemical tracer material and the formation fluids.

DETAILED DESCRIPTION

The present invention will now be described in detail with reference to the figures in which.

Figure 4:
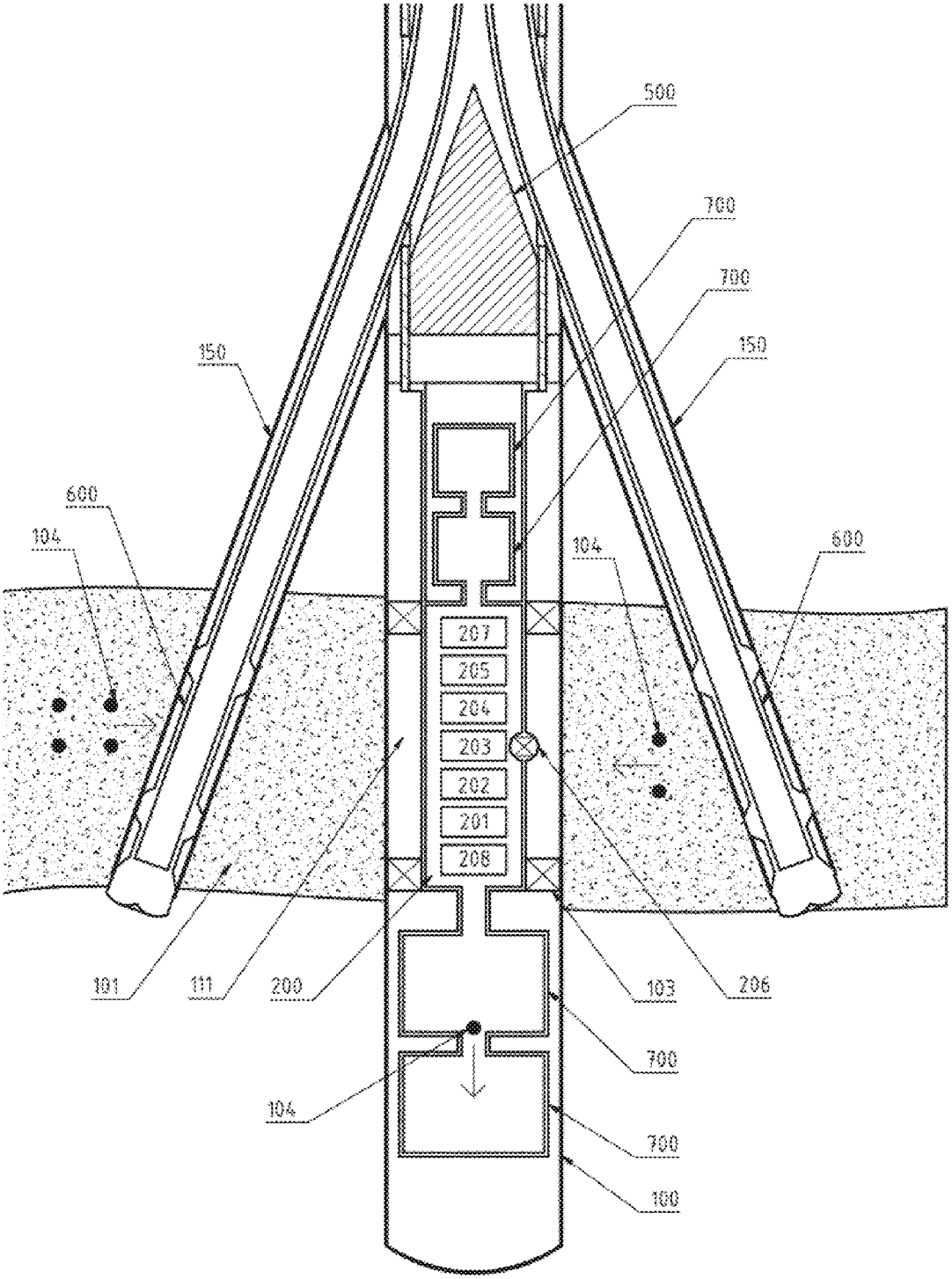

FIG. 4 is a side view of a general drawing outlining the main elements of another embodiment of the downhole intelligent well testing system containing two chemical release tools, one in each of two sidetracked wellbores and an intelligent well testing tool with downhole production or sample chambers in a third adjacent wellbore, all connected to the surface via a test string, and all wellbores intersecting the same formation of interest.

Figure 5:
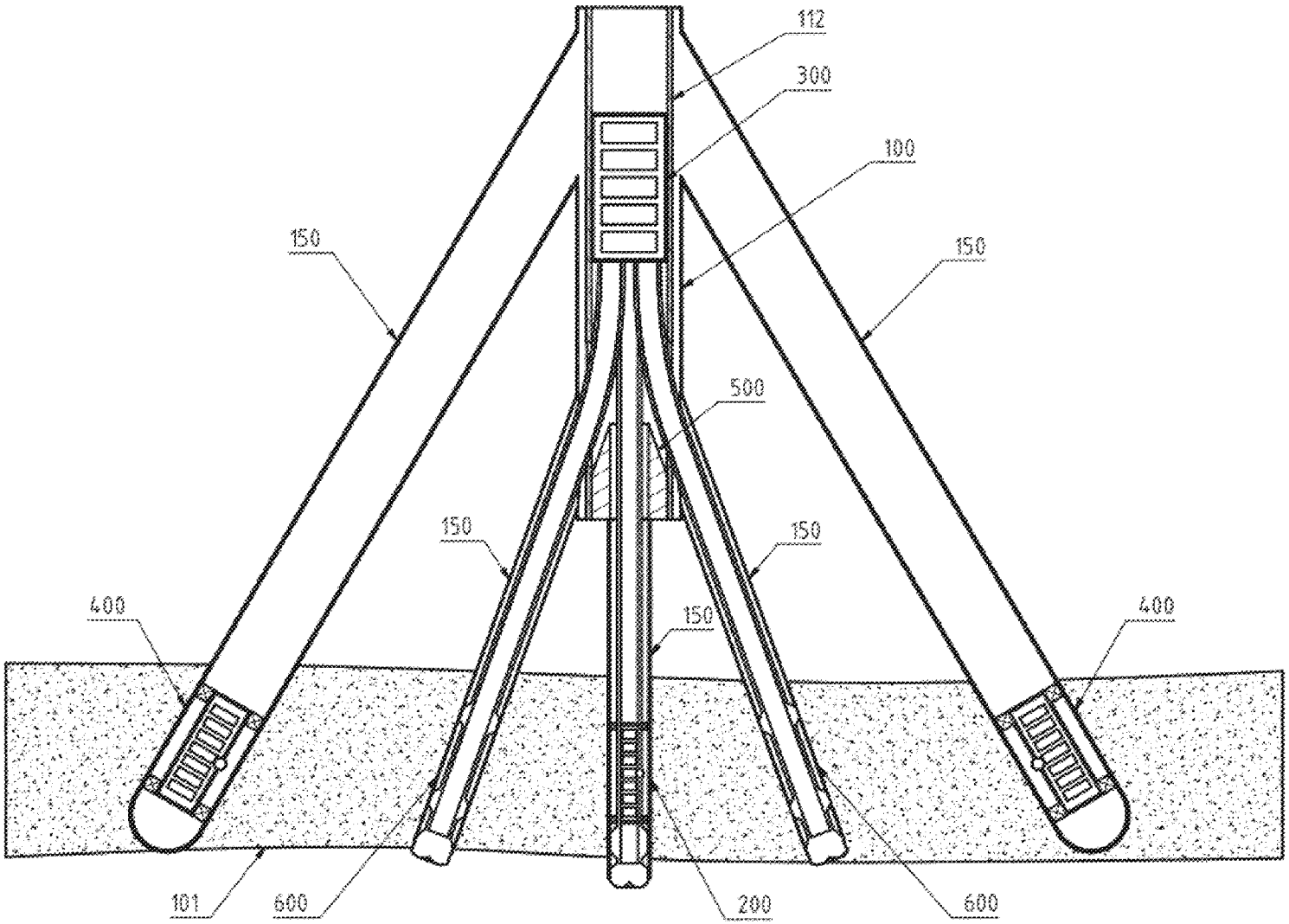

FIG. 5 is a side view of a general drawing outlining the main elements of another embodiment of the downhole intelligent well testing system containing two isolated chemical release drones in two outer wellbores sidetracked distantly from the main wellbore, two chemical release tools in each of two sidetracked inner wellbores and an intelligent well testing tool in a third sidetracked adjacent wellbore, all three are connected and operated through a downhole measurement while testing tool at the upper end, and further connected to the surface via a test string, and all wellbores are intersecting the same formation of interest.

Figure 6:
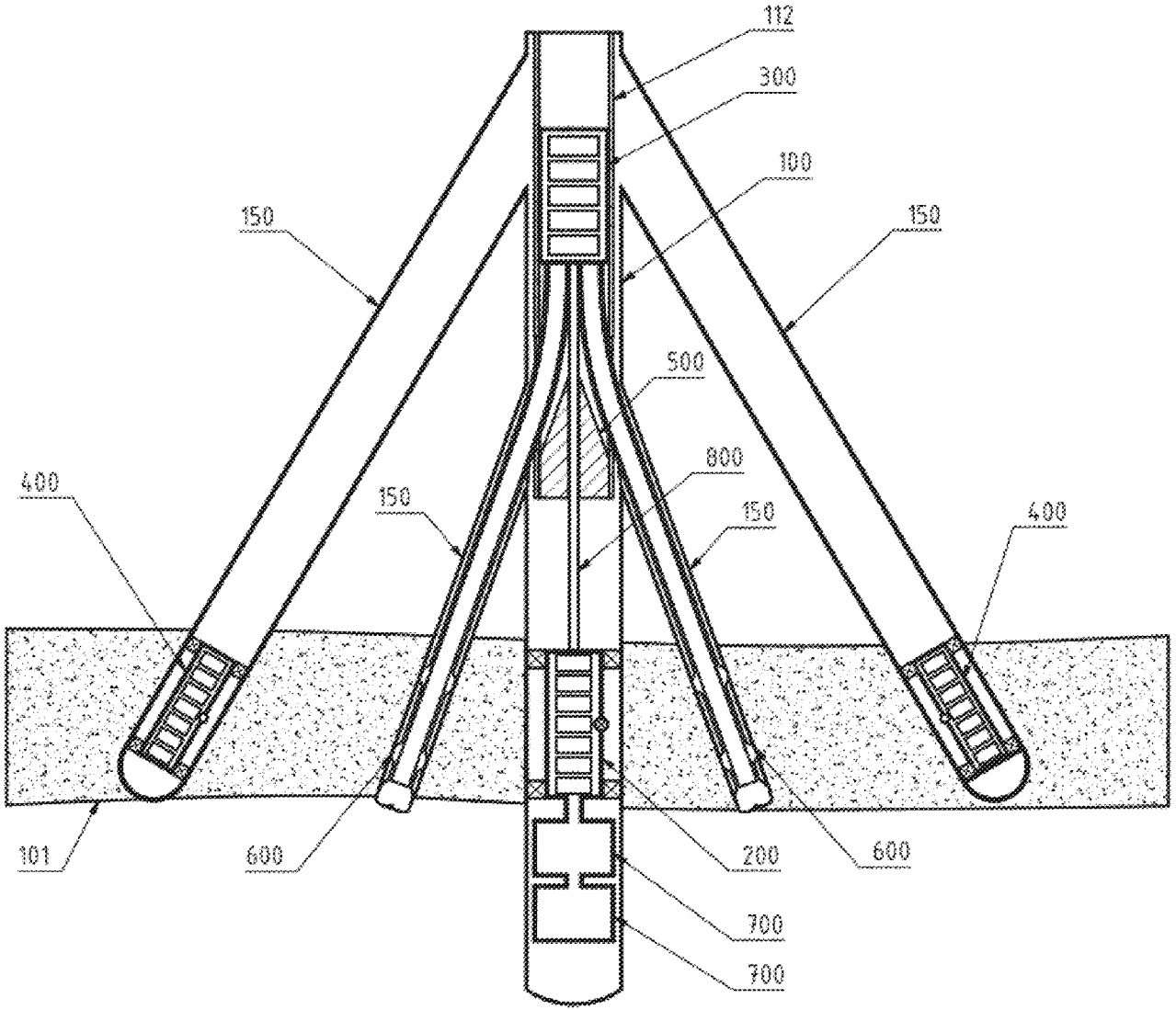

FIG. 6 is a side view of a general drawing outlining the main elements of another embodiment of the downhole intelligent well testing system containing two isolated chemical release drones in two wellbores sidetracked distantly from the main wellbore, two chemical release tools in each of two sidetracked wellbores adjacent to an intelligent well testing tool in a third main wellbore, with an intelligent well testing tool with downhole production chambers connected to a downhole measurement while testing tool at the upper end through a wired shaft or pipe, further connected to the surface via a test string and, and all wellbores intersecting the same formation of interest.

Figure 7:
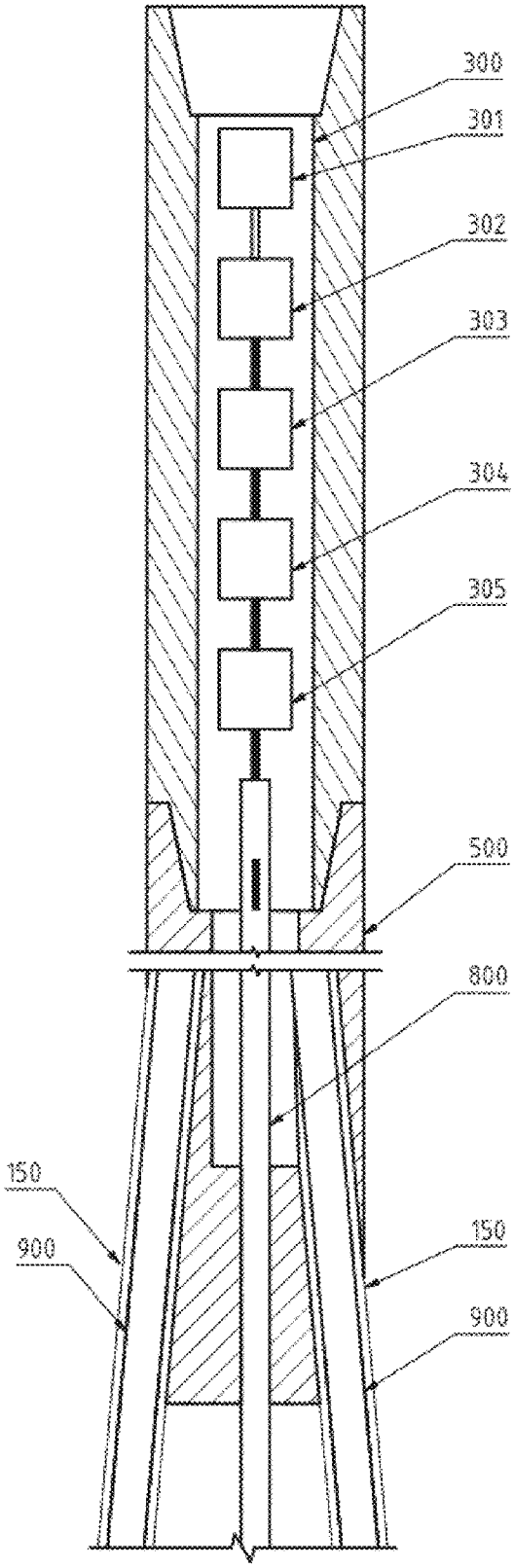

FIG. 7 is a close up, side view of a general drawing outlining the main elements of the downhole measurement while testing tool containing a two-way communication device such as a pulser assembly, a power module, an electronics and memory module and a sensor module, this measurement while testing tool being connected to the lower intelligent well testing tool through a wired shaft or pipe, and additionally connected to two chemical release tools in each of two or three sidetracked wellbores, drilled with a dual or triple whipstock assembly.

Figure 8:
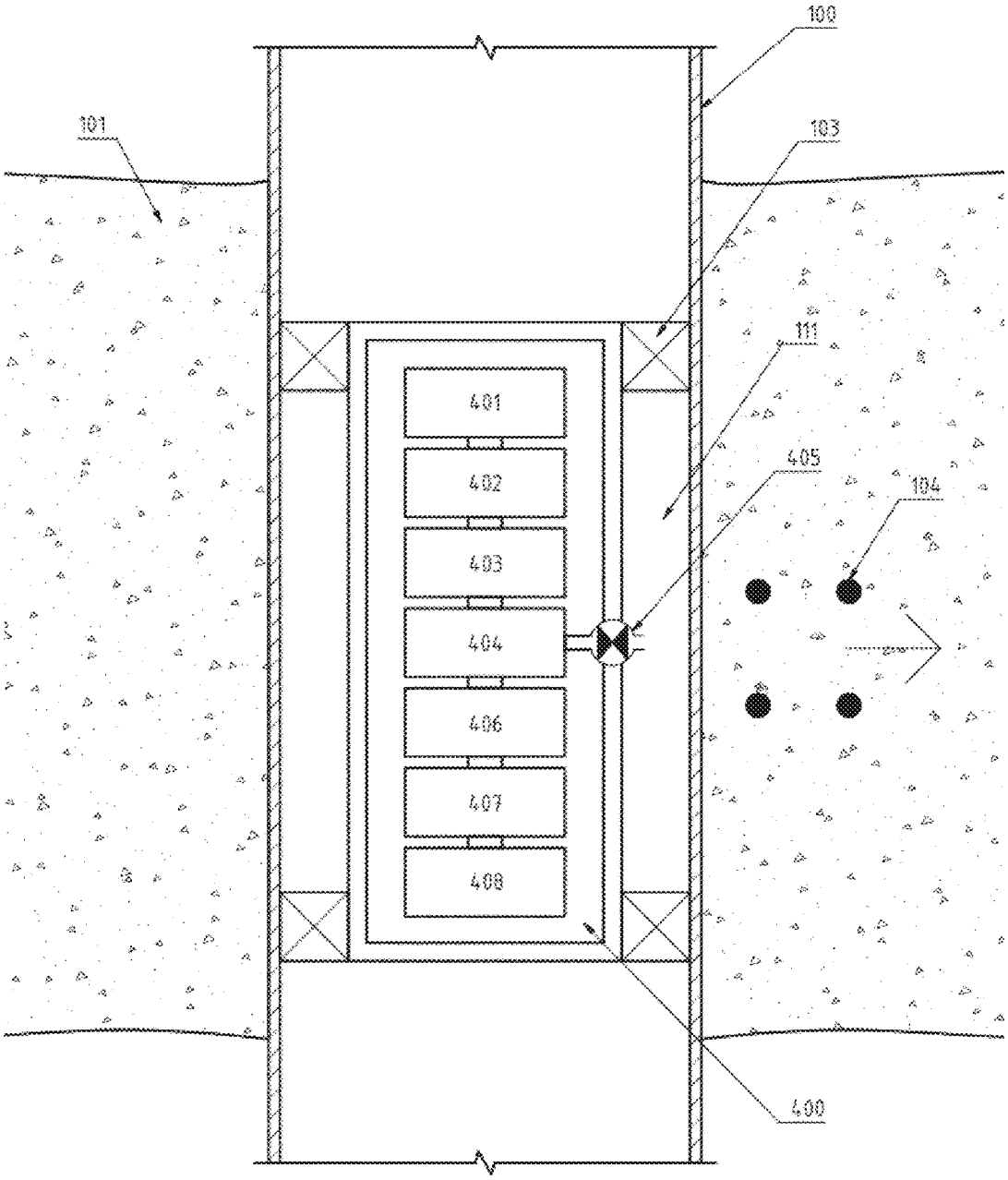

FIG. 8 is a close up, side view of a general drawing outlining the main elements of an isolated chemical release drone, containing a dual inflatable packer assembly isolating the zone of interest, a power supply module, an electronics and memory module, a sensor module, one or more tracer material chambers, a well test device downhole pump, a port or valve for releasing chemical tracer material to the formation of interest, an axial transmitter and receiver module for communicating uphole to the measurement while testing system and a lateral transmitter and receiver module for communication through the formation of interest to the intelligent well testing system.

Figure 9:
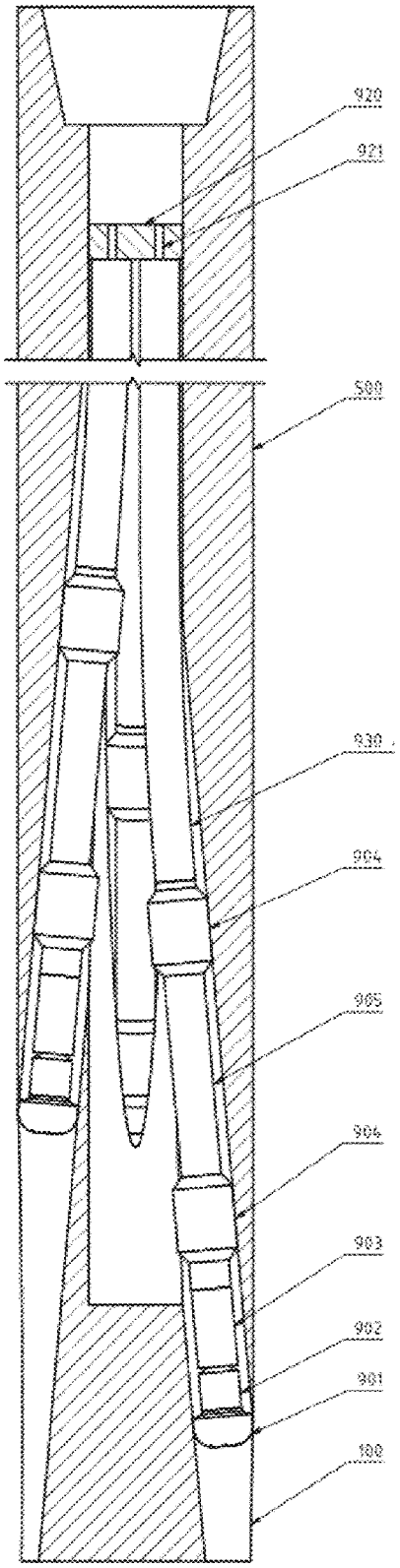

FIG. 9 is a close up, side view of a general drawing outlining the main elements of a triple whipstock assembly, enabling simultaneous drilling of three laterals kicked off from individual slots in the whipstock assembly, ideally spread radially 120 degrees apart, exiting the main wellbore at approximately but not exactly the same depth and simultaneously drilled with the aid of a piston arrangement on the top to simultaneously apply weight to the three drill strings.

Figure 10:
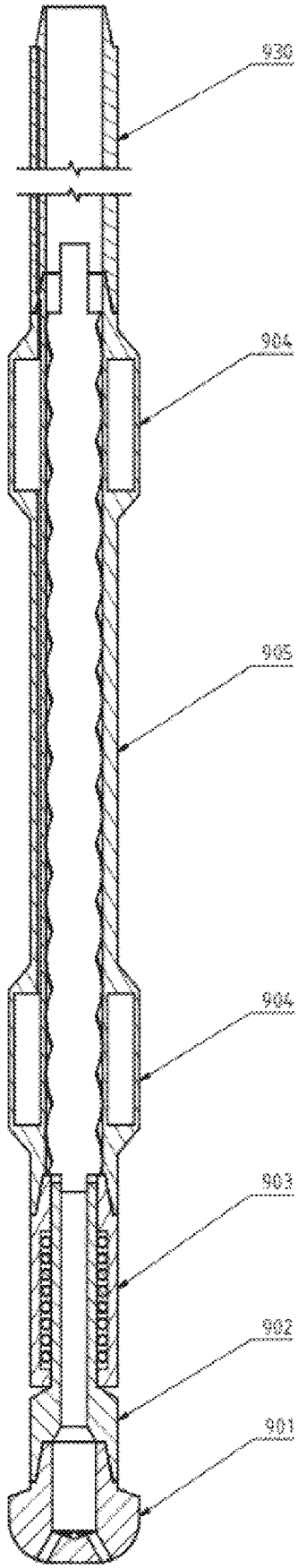

FIG. 10 is a close up, side view of a general drawing outlining the main elements of a sidetrack drilling assembly, with a wired drill pipe at the upper end for communication to the measurement while testing tool, weight transfer from the aforementioned piston arrangement, where the rotational force on the drill bit is provided by a wired, hydraulically operated mud motor, the wiring providing power and communication from the measurement while testing tool above to the one or more chemical release chambers that are ideally mounted in the blades of the stabilizer assemblies of the mud motor, or other convenient location on the sidetrack assembly.

Figure 11:
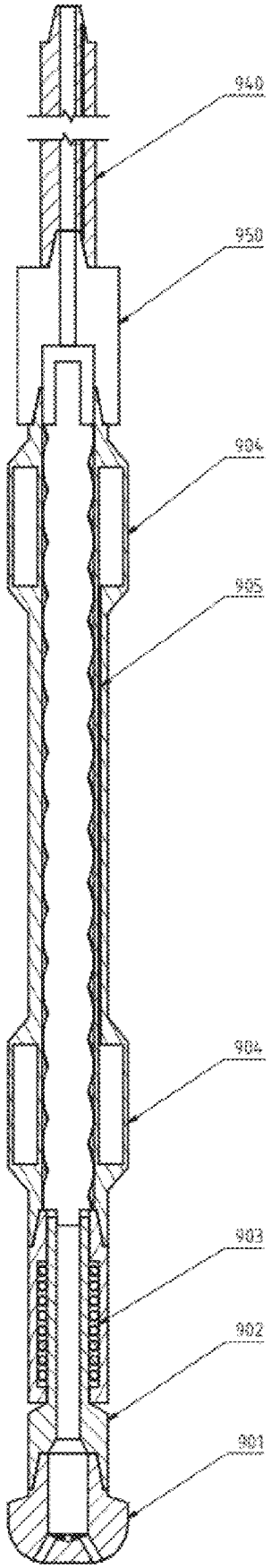

FIG. 11 is principally the same as FIG. 10, but with a wired coil tubing used between the instrumented sidetrack assembly below and measurement while testing tool above. To apply weight to the drill bit the piston arrangement cannot be used due to the coil tubing being flexible, instead a hydraulically operated inventive weight-on-bit tool is used to enable the sidetracks to be drilled. This enables the drilling of the sidetracks to be done in sequence as opposed to simultaneously.

Figure 12:
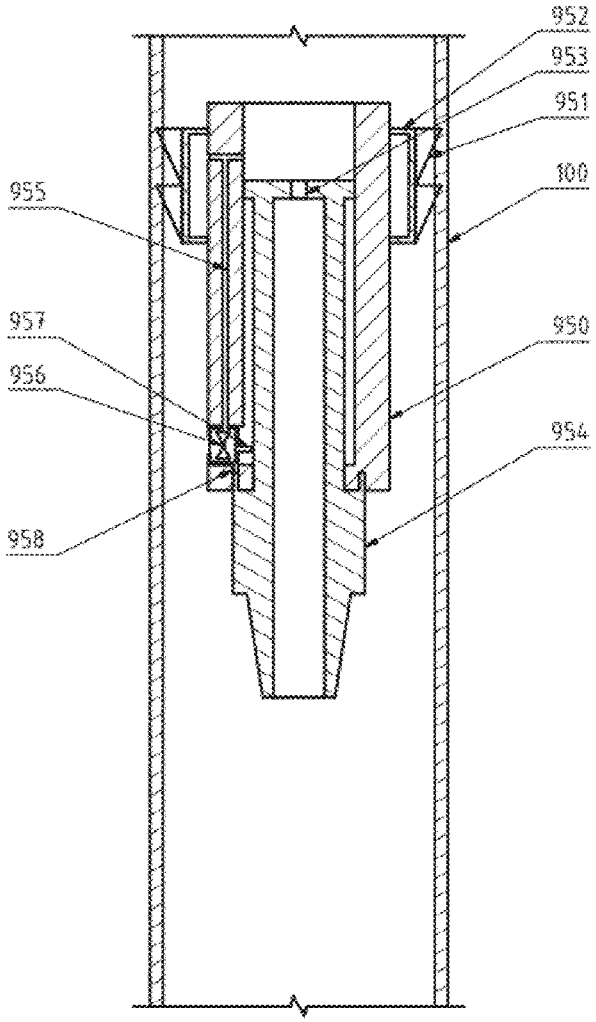
Figure 13:
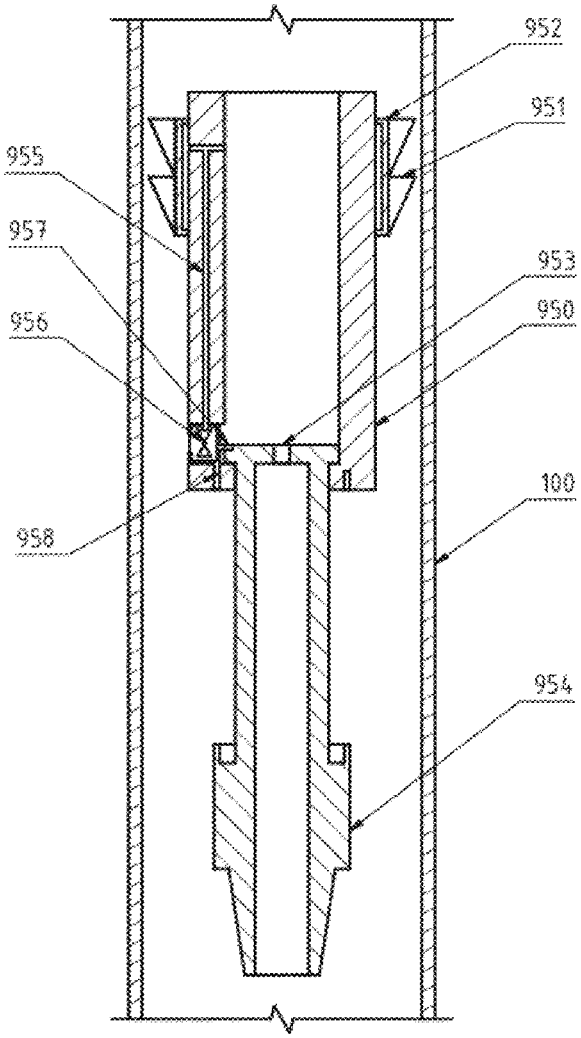

FIG. 12 is a close up, side view of a general drawing outlining the main elements of a weight-on-bit tool, used to convert hydraulic force from the mud flow through the coil tubing pipe to mechanical force enabling the mud motor and the drill bit to be pushed forward and drilling of the side track to progress, the piston being in the upper, compressed position;

FIG. 13 is principally the same as FIG. 12, but with the WOB piston being in the lower, extended position.

Figure 14:
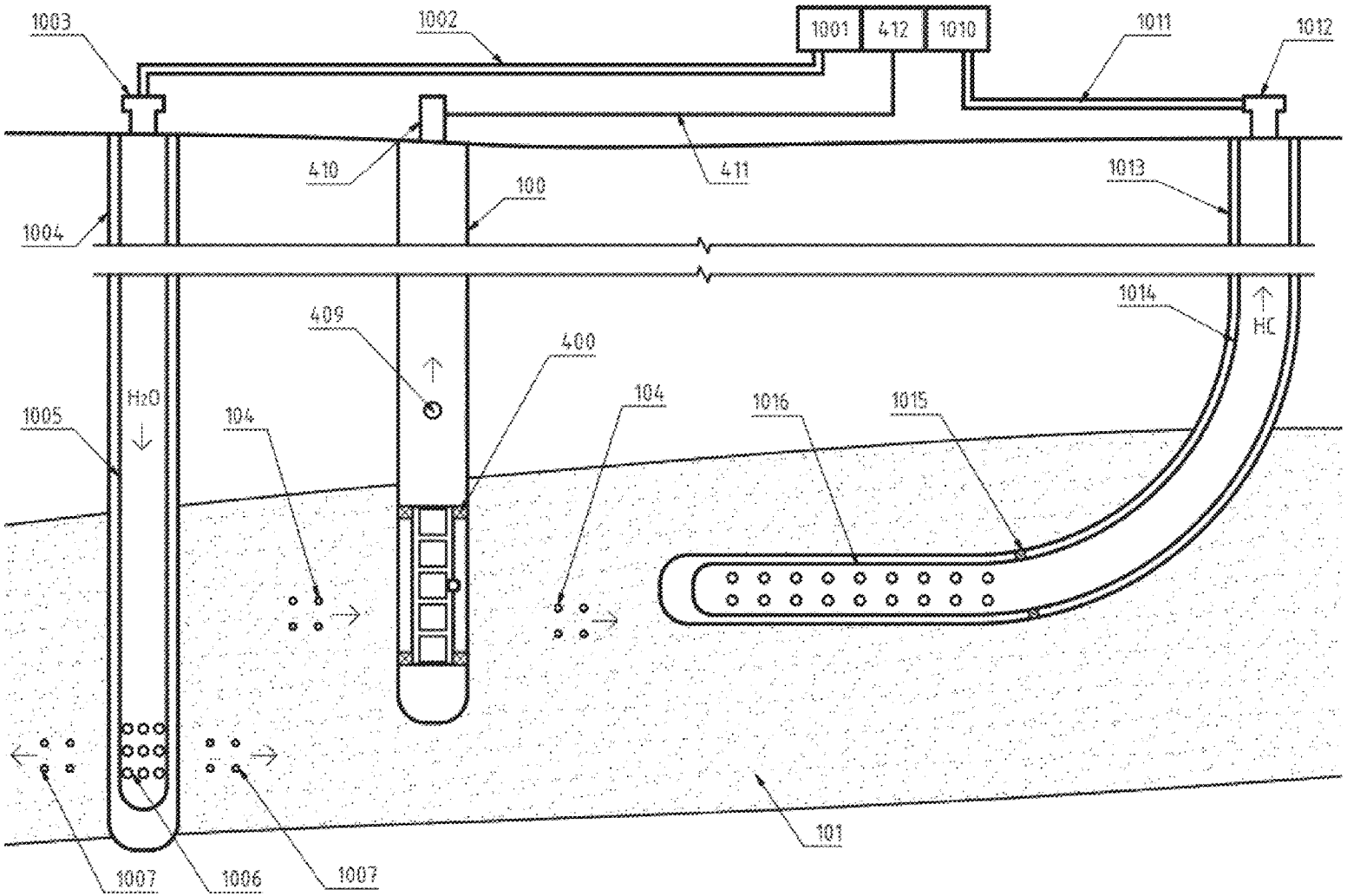

FIG. 14 is a side view of a general drawing outlining the main elements of an isolated drone chemical release module installed permanently as part of a field development solution. One or more isolated drone chemical release modules are installed in dedicated wellbores intersecting the reservoir, these wellbores being drilled specifically for the purpose, or wellbores from the exploration phase may be re-used in the production phase. The field development solution further consisting of one or more production wells, and potentially also one or more injection wells. The isolated drone chemical release module may be used to periodically release chemical tracer material that will be transported with the flowing reservoir fluids through the reservoir rock and into a nearby production wellbore. The presence of the chemical tracer material is registered downhole if the production well is instrumented with a suitable sensor. Alternatively, it is registered by a surface sensor.

The following examples of embodiments of the invention is described with reference to the figures.

Figure 1:
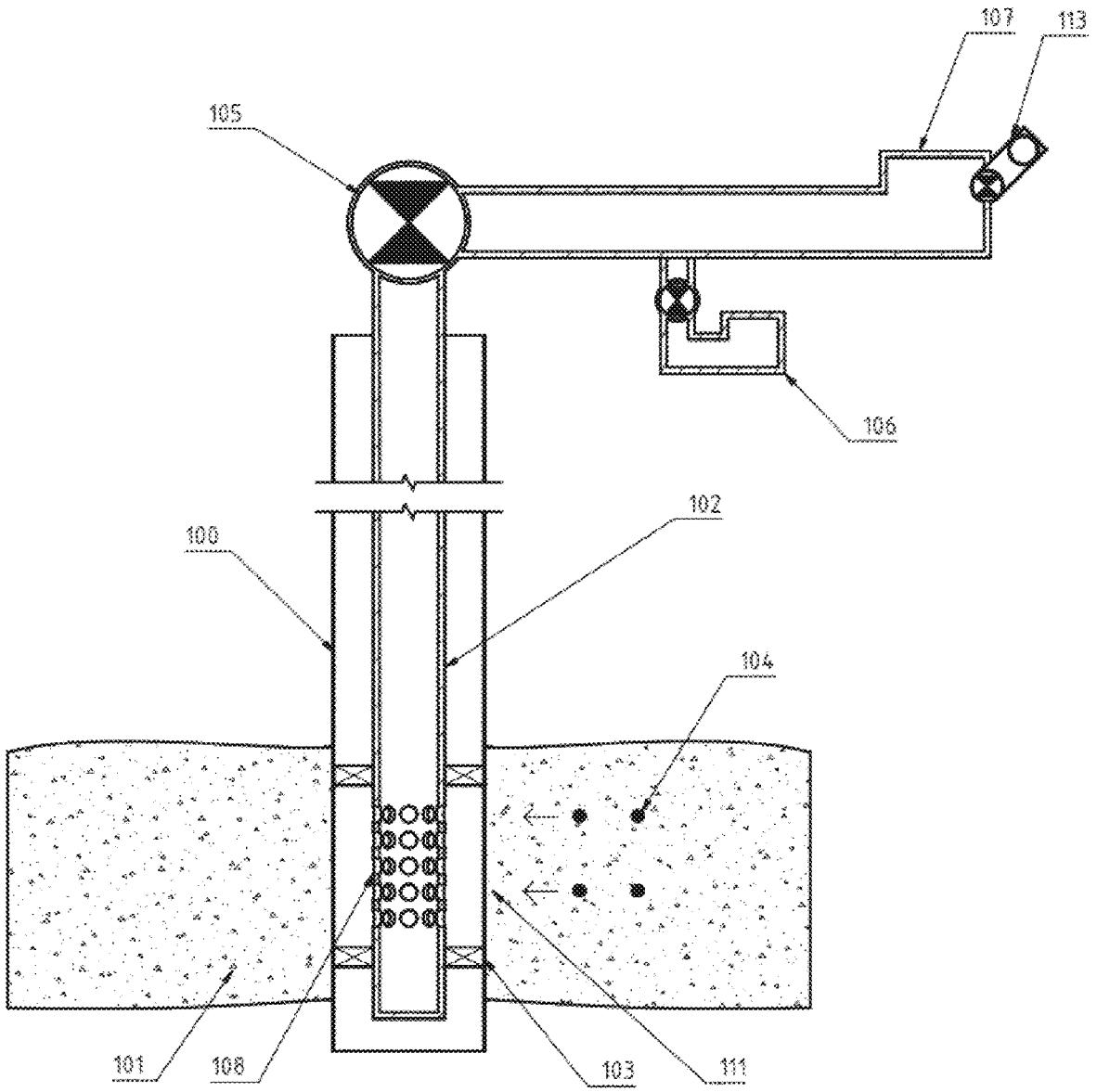
Fig. 1 (prior art)
FIG. 1 is a side view of a conventional well testing system containing a downhole dual packer arrangement isolating a formation of interest connected to a surface well test system through a production test tubing.

FIG. 1 is a side view illustration of a generalized prior art, a conventional well testing system, comprising a primary wellbore 100 that intersects the subsurface formation 101. A well test string 102 is positioned in the center of the wellbore, with an isolation packer arrangement 103 isolating a zone of interest within the subsurface formation 101. Lowering the hydraulic pressure causes formation fluids 104 to flow towards the isolated annular space 111 in the wellbore and through well test ports 108 into the well test string 102 or tubing, which is connected to a surface well test system comprising a well test control valve 105, surface sample chambers 106 for collecting formation fluids, and surface processing equipment 107. Excess hydrocarbons produced in the well test operation is finally flared off in the hydrocarbon burner 113.

Figure 2:
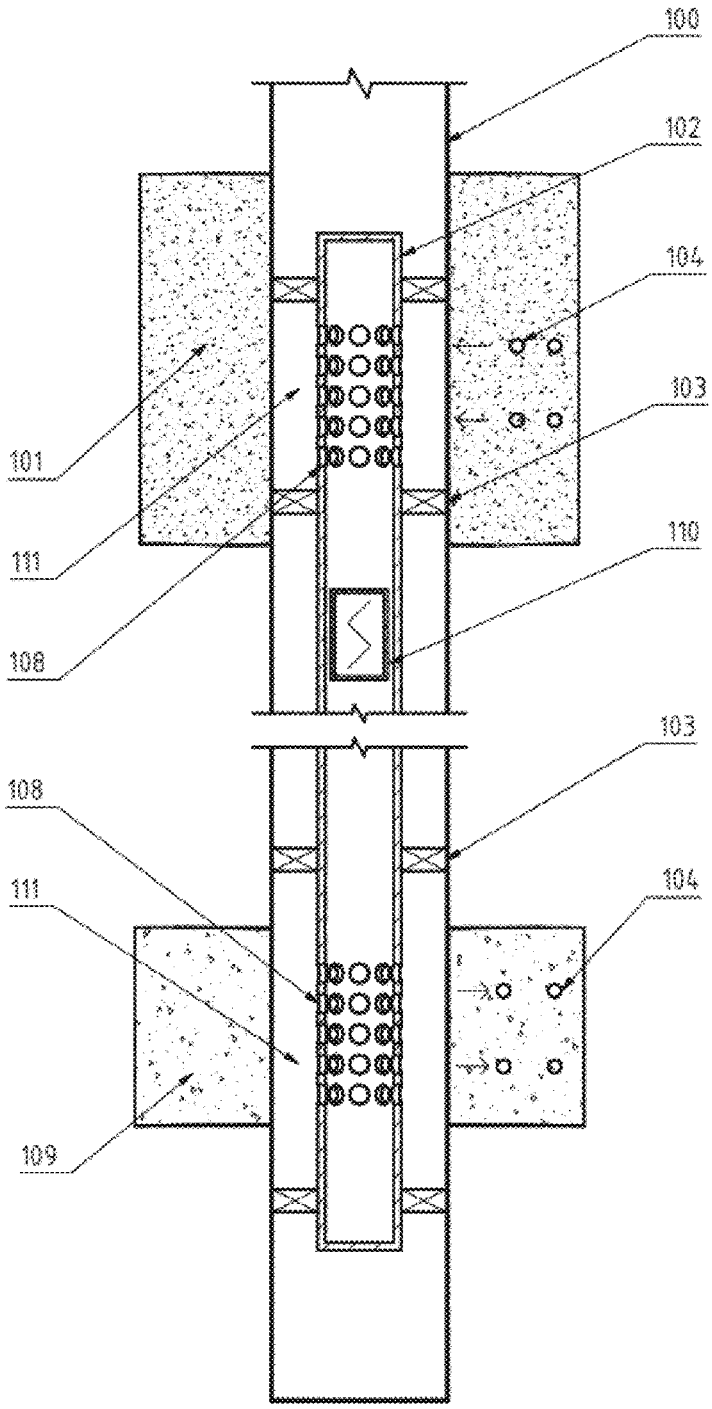
Fig. 2 (prior art)
FIG. 2 is a side view a downhole well testing system containing two dual packer arrangements isolating two formations of interest for production of formation fluid from one zone and injection in another zone, connected through a downhole well test string.

FIG. 2 is a side view illustration of a prior art downhole well testing system, comprising a primary wellbore 100 that intersects the subsurface formation 101 and another permeable formation for injection 109. A well test string 102 or tubing is positioned in the center of the wellbore and contains two isolation packer arrangements 103, thus isolating two subsurface formations of interest, the upper for production of formation fluids 104 from the subsurface formation 101 and the lower for injection of the said produced formation fluids 104 into the formation for injection 109. The production test tubing further comprises a downhole pump 110 that moves the produced formation fluids 104 from the production subsurface formation 101, into the well test string 102 through well test ports 108, and out through another section of well test ports 108 in the injection part of the string, to the wellbore annular space 111 and generates sufficient positive pressure differential for the fluids to be injected into the lower formation for injection 109.

Figure 3:
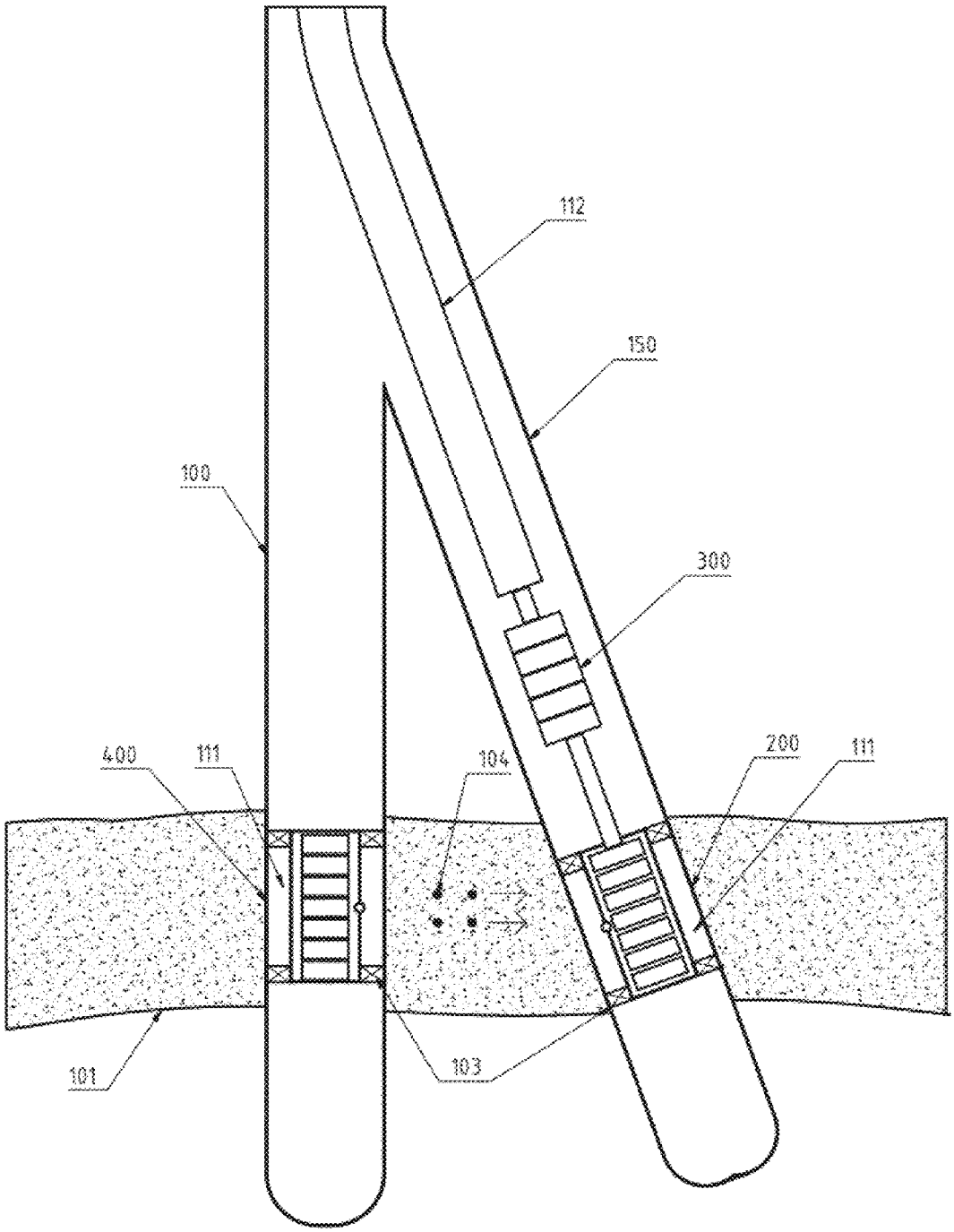
FIG. 3 is a side view of a general drawing outlining the main elements of the downhole intelligent well testing system according to the invention, containing one isolated chemical release drone in one wellbore and an intelligent well testing tool in an adjacent, sidetracked wellbore, connected to the surface via a test string, and where both wellbores intersecting the same formation of interest.

FIG. 3 is a side view of a general illustration outlining the main elements of an embodiment of the present invention. A primary wellbore 100 penetrates a subsurface formation 101, whereas a sidetracked secondary wellbore 150 penetrates the same subsurface formation 101 some distance away. In both wellbores, a zone of interest is isolated with an isolation packer arrangement 103 in a manner similar to that described above with reference to FIG. 1 and FIG. 2. The isolation packer arrangement 103 will isolate the annular space 111 between the subsurface formation of interest 101 and well test equipment such as a well test system 200 and well test devices 400 in the respective wellbores. The figure illustrates an embodiment where the well test device 400 is installed in the primary wellbore 100, which is the first drilled wellbore, and where the well test system 200 is installed in the secondary wellbore 150. In another embodiment, the well test system 200 is installed in the primary wellbore 100 and the well test device 400 is installed in the secondary wellbore 150. This embodiment is described more in detail below with reference to the figures showing embodiments with several sidetracked wellbores.

In one embodiment, the well test device 400 comprises one or more chemical tracer material(s). A test string 112 carries an intelligent well test system 200 into the secondary wellbore 150. As formation fluid is produced into the well testing system 200 in the secondary wellbore 150, and chemical tracer material is released from the well test device 400 and transported through the subsurface formation of interest 101 with the flow of formation fluids comprising additional properties 104 and will upon arrival into the well testing system 200 be measured and registered along with other key parameters pertaining to the well test. A well test system 300 for collecting data and communicating to surface is connected to the well test system 200.

FIG. 4 is a side view of a general illustration outlining the main elements of another embodiment of the present invention, including a close-up view of the well test system 200. A primary wellbore 100 penetrates a subsurface formation of interest 101. A well test system 200 is installed in the primary wellbore 100. comprising a power supply 201, downhole system electronics and memory module 202, a well test system downhole pump 203, a chemical tracer material detection module 204, a downhole sensor module 205, a fluid inlet and control valve 206 for allowing formation fluids 104 to enter the well test system 200, an axial transmitter and receiver module 207 for data transfer between the downhole well test system 200 uphole to the well test control system 300 (not shown), and a lateral transmitter and receiver module 208 for data transfer to other well testing equipment installed in adjacent wellbores within the subsurface formation 101. Additionally, the tool comprises a multi-well sidetrack module 500 for employing one or more sidetrack drill strings with connected well test device 600 that can drill one or more smaller diameter secondary wellbores 150 at an angle and distant to the primary wellbore 100 to intersect the same subsurface formation of interest 101, each of these sidetrack drill strings with connected well test device 600 further containing apparatus for the release of chemical tracer material. The well testing tool may also include one or more reservoir fluid sample chambers 700 that can be placed in proximity to and be connected to the intelligent well test system 200. During a drawdown well test the formation fluids 104 will flow through the subsurface formation of interest 101 into the annular space 111 established by the isolation packer arrangement 103 and further into the intelligent well test system 200, and when allowed into the one of the sample chambers 700, the opening and closing of each sample chamber individually controlled by electronics and memory module 202 of the well test system 200.

FIG. 5 is a side view of a general illustration outlining the main elements of another embodiment of the downhole intelligent well test system, containing two well test devices 400 in two outer secondary wellbores 150 drilled distantly from the primary wellbore 100, with three additional inner secondary wellbores 150 sidetracked from the primary wellbore 100 by the means of a multi-well sidetrack module 500, with a drill string with connected well test device 600 installed in two of the sidetracked inner secondary wellbores 150 and a well test system 200 installed in the third sidetracked inner secondary wellbore 150, the said drill strings with connected well test device 600 and the said well test system 200 all connected to and operated from a downhole well test control system 300 at the upper end, further connected to the surface via a test string 112, and all wellbores intersecting the same subsurface formation of interest 101.

FIG. 6 is a side view of a general drawing outlining the main elements of another embodiment of the downhole intelligent well testing system containing two well test devices 400 in two outer secondary wellbores 150 drilled distantly from the main wellbore 100, a well test system 200 with two sample chambers 700 installed in the primary wellbore 100, two additional inner secondary wellbores 150 sidetracked from the primary wellbore 100 by the means of a multi-well sidetrack module 500, a drill string with connected well test device 600 in each of the two sidetracked inner secondary wellbores 150 connected to the well test control system 300 above, the intelligent well test system 200 also connected to the well test control system 300 with a wired connection pipe 800, the said well test control system 300 further connected to the surface via a test string 112 and all wellbores intersecting the same subsurface formation of interest 101. The wired connection pipe connection pipe 800 connecting the well test control system 300 and the intelligent well test system 200 is ideally installed and connected simultaneously to drilling the inner secondary wellbores 150 with the said drill strings with connected well test device 600.

FIG. 7 is a general drawing showing a close up, side view outlining the main elements of the well test control system 300, containing a two-way communication transmitter and receiver module 301 such as a pulser assembly for communication uphole with a surface receiver, a power supply 302 such as a battery or a turbine/alternator assembly, an electronics and memory module 303 for controlling the system, a sensor module 304 for measuring certain parameters related to the well test operation, and an axial transmitter and receiver module 305 for communication downhole with the well test system 200 (not shown), the said well test control system 300 being connected to the said lower intelligent well test tool 200 through a wired connection pipe 800, and additionally connected to a sidetrack drillstring 900 further connected to a drill string with connected well test device 600 (not shown) in each of two sidetracked secondary wellbores 150, drilled from a multi-well sidetrack module 500.

FIG. 8 is a close up, side view of a general drawing outlining the main elements of a well test device 400 installed in a primary wellbore 100 intersecting a subsurface formation of interest 101, containing an axial transmitter and receiver module 401 such as a pulser assembly for transmission uphole to the well test control system 300 (not shown), an electronics and memory module 402 for controlling the system, a sensor module 403 for measuring certain parameters of interest for the well test operation such as pressure, temperature, time and confirmation of the release of chemical tracer material, a chemical tracer material chamber 404, a chemical tracer material release port 405 and a well test device downhole pump 406 for pumping the said chemical tracer material into the annular space 111 between the isolation packer arrangement 103, a power supply 407 such as a battery module and a lateral transmitter and receiver module 408 for communication with the intelligent well test system 200 (not shown) through the subsurface formation of interest 101. It should be noted that the well test device 400 may be operated with or without the isolation packer arrangement 103 as the chemical tracer material will nevertheless be ejected into the primary wellbore 100 and be transported to the intelligent well test system 200 with the formation fluids 104 when they are flowing. It should further be noted that in the case of performing a well test as described, the axial transmitter and receiver module 401 may communicate with the well test control system 300 above, while in the case of a permanently installed well test device 400, there may not be a well test control system 300 above and instead the information from the said well test device 400 is communicated to surface by the means of releasing flowable devices 409 (not shown) periodically, unless it is connected to the surface with a wired pipe as part of the downhole well completion system.

FIG. 9 is a close up, side view of a general drawing outlining the main elements of a multi well sidetrack drilling system, drilled from a multi-well sidetrack module 500. In the relevant figure it is illustrated three sidetrack drillstrings 900, consisting of from the lower end the drill bit 901 for cutting the formation, the drive shaft 902 for transferring the power from the wired mud motor (PDM) power section 905 to the said drill bit 901, the bearing assembly 903 for enabling the drill bit and drive shaft to rotate while the remainder of the sidetrack drillstring 900 remains non-rotational, two stabilizers with chemical tracer material release chambers 904 for providing the appropriate inclination build properties to allow the sidetrack drilling assembly to achieve a sufficient inclination and distance to the primary wellbore 100. Each sidetrack drillstring 900 is further connected to the well test control system 300 above (not shown) using either a wired sidetrack drillstring 930 or a wired sidetrack coil tubing 940. On top of the sidetrack drillstring arrangement is a drilling mud distributor 920 to ensure the drilling mud is pumped from the surface is evenly distributed between the sidetrack drillstrings 900 through channels to sidetrack drill strings 921. Furthermore, the well test control system 300 above is allowed to communicate through each of the wired sidetrack drillstrings 930 or the wired sidetrack coil tubing 940 to each of the stabilizers with chemical tracer material release chamber 904. This allows chemical tracer material of unique signature to be individually released to the subsurface formation of interest for well testing from individual chemical tracer material chambers.

FIG. 10 is a close up, side view of a general drawing outlining the main elements of a multi well wired sidetrack drillstring 930, consisting of from the lower end the drill bit 901 for cutting the formation, the drive shaft 902 for transferring the power from the wired mud motor (PDM) power section 905 to the said drill bit 901, the bearing assembly 903 for enabling the drill bit and drive shaft to rotate while the remainder of the wired sidetrack drillstring 930 remains non-rotational, two stabilizers with chemical tracer material release chambers 904 for providing the appropriate inclination build properties. The wired mud motor (PDM) power section 905 consists of an outer stator section which is wired to allow communication from the well test control system 300 above (not shown) to the stabilizers with chemical tracer material release chambers 904, and an inner rotor section that will rotate and provide power to the drill bit 901 when drilling mud is pumped through the said wired motor power section 905.

FIG. 11 is a close up, side view of a general drawing outlining the main elements of a multi well wired sidetrack coil tubing 940. The drilling motor assembly comprising parts 901-905 is identical to those of FIG. 10 above. As a coil tubing string is flexible and will buckle under compression, the weight to the mud motor and drill bit section cannot be applied by a pushing force from above. A wired weight-on-bit tool 950 is placed above the sidetrack drilling motor assembly 901-905 to allow weight to be transferred to the drill bit 901 therethrough.

FIG. 12 is a close up, side view of a detailed drawing outlining the main elements of a wired weight-on-bit tool 950 in a compressed position, to be run on top of the drilling motor assembly 901-905 (not shown) and below the wired sidetrack coil tubing 940 (not shown). During drilling of the sidetrack drilling mud is pumped from surface down through the wired sidetrack coil tubing 940. The mud will be pumped through the restrictor 953. The valve 956 is closed and the pressure will inflate the gripper packer 952 which keeps the wired weight-on-bit tool 950 in position in the primary wellbore 100 by the gripper 951. At the same time the mudflow put pressure on piston 954 which will be pushed down and apply a downhole force onto the said drilling motor assembly. Once the piston 954 is at its lowermost position as shown in FIG. 13 the valve opening mechanism 957 will be activated and the valve 956 will open the connection between the hydraulic bore 955 and the annulus. Due to the lower pressure the gripper 951 will collapse and lose contact with the primary wellbore 100. The wired weight-on-bit tool 950 will be pushed downwards by flow and gravity until it reaches the compressed position as shown in FIG. 12. In the compressed position the valve closing mechanism 958 will be activated to close the valve 956 and subsequently to inflate the gripper packer 952 again and the process can be repeated.

FIG. 13 is a close up, side view of a detailed drawing outlining the main elements of a wired weight-on-bit tool 950 in the extended position, as described above.

FIG. 14 is a side view of a general drawing outlining the main elements of a well test device installed permanently as part of a field development solution. A well test device 400 is installed in a primary wellbore 100 intersecting the subsurface formation of interest 101. Periodically, by signal travelling laterally through the earth from a nearby lateral signal transmitter, or through the earth or the wellbore from surface, or controlled by a timer device, the well test device 400 will release chemical tracer material that will travel through the formation of interest 101 with the formation fluids 104. Information from the well test device 400, such as pressure and temperature measurements, time, and confirmation of release of chemical tracer material, may be transmitted to the surface by periodically releasing a flowable device with data memory 409. The said flowable device with data memory 409, being lighter than the wellbore fluid, will travel to the surface by buoyancy. At surface it will be collected by a flowable device receiver and data readout unit 410, the said data being further transmitted to a central data processing unit for flowable device 412 through a dedicated power and communications line 411. One or more production wells may be installed in the reservoir, consisting principally of a production wellbore 1013, a production tubing 1014 installed therein with an isolation packer 1015 for isolating the zone of interest in the subsurface formation 101 and perforations in the production tubing 1016 for allowing formation fluids 104 to be produced to surface through the wellhead production well 1012, the production flowline 1011 and into the production processing module 1010. Optionally, one or more injection wells may be installed in the reservoir, such as a gas injector or a water injector, the latter shown in the illustration. Injection water 1007 is pumped from the injection pump 1001 through the flowline for water injection 1002 and the wellhead for the water injection well 1003. The water is further pumped down through the injection tubing 1005 which is installed in the injection wellbore 1004, out through the perforations in the injection tubing 1006 and into the subsurface formation of interest 101. Over time, as hydrocarbons such as oil is removed from the reservoir, and water or gas is injected into the reservoir, or migrating through the reservoir from above (gas) or below (water), the directional permeability and the directional mobility of the formation fluids will change, thereby rendering repeated measurements of these vital parameters to be particularly valuable for the drainage strategy of the reservoir.

FIGURE REFERENCES

100 Primary wellbore
101 Subsurface formation
102 Well test string
103 Isolation packer arrangement
104 Formation fluids
105 Well test control valve
106 Surface sample chamber
107 Surface processing equipment
108 Well test ports
109 Formation for injection
110 Downhole pump
111 Annular space
112 Test string
113 Hydrocarbon burner
150 Secondary wellbore
200 Well test system
201 Power supply
202 Electronics and memory module
203 Well test system downhole pump
204 Chemical tracer detection module
205 Sensor module
206 Fluid inlet and control valve
207 Axial transmitter and receiver module
208 Lateral transmitter and receiver module
300 Well test control system
301 Transmitter and receiver module
302 Power supply
303 Electronics and memory module
304 Sensor module
305 Axial transmitter and receiver module
400 Well test device
401 Axial transmitter and receiver module
402 Electronics and memory module
403 Sensor module
404 Chemical tracer material chamber
405 Chemical tracer material release port
406 Well test device downhole pump
407 Power supply
408 Lateral transmitter and receiver module
409 Flowable device with data memory
410 Flowable device receiver and data readout unit
411 Power and communications line
412 Data processing unit for flowable device
500 Multi-well sidetrack module
600 Drill string with connected well test device
700 Sample chambers
800 Wired connection pipe
900 Sidetrack drillstring
901 Drill bit
902 Drive shaft
903 Bearing assembly
904 stabilizer with chemical tracer material release chamber
905 Wired mud motor (PDM) power section
920 Drilling mud distributor
921 Channels to sidetrack drill strings
930 Wired sidetrack drill string
940 Wired sidetrack coil tubing
950 Wired weight-on-bit tool
951 Gripper
952 Gripper packer
953 Restrictor
954 Piston
955 Hydraulic bores
956 Valve
957 Valve opening mechanism
958 Valve closing mechanism
1001 Injection pump
1002 Flowline for water injection
1003 Wellhead for water injection well
1004 Injection wellbore
1005 Injection tubing
1006 Perforations in injection tubing
1007 Injection water
1010 Production processing module
1011 Production flowline
1012 Wellhead production well
1013 Production wellbore
1014 Production tubing
1015 Isolation packer
1016 Perforations in production tubing

The invention claimed is:

1. A method for characterizing reservoir properties when producing formation fluids from a subsurface formation comprising:

establishing a primary wellbore intersecting the subsurface formation, establishing a secondary wellbore intersecting the same subsurface formation as the primary wellbore, where the secondary wellbore is sidetracked from, or drilled in proximity to, said primary wellbore, installing one or more well test devices in a selected annular space in either the primary wellbore or the secondary wellbore, and isolating the selected annular space by means of an isolation packer arrangement, installing a well test system in a selected annular space in the other either primary wellbore or secondary wellbore, and isolating the selected annular space by means of an isolation packer arrangement, the well test system is connected to a well test control system attached to a test string, establishing a fluid communication path from said subsurface formation to the well test system, and letting formation fluids from the subsurface formation flow into the selected annular space and measuring and monitoring at least flow rate and pressure properties of produced formation fluids by means of the well test system, characterized in activating the one or more well test devices and measuring and monitoring additional properties of the produced formation fluids of the subsurface formation located between the primary wellbore and the secondary wellbore, by means of the well test system, and collecting, in one or more sample chambers, at least one fluid sample from the subsurface formation fluids-flowing into the well test system and re-injecting fluids not required into the formation by means of a downhole pump.

2. The method as claimed in claim 1, further comprising activating a pre-programmed timer device, or transmitting signals from the well test control system to the one or more well test device for releasing one or more chemical tracer material(s), or other material(s) with distinct signature(s) from the one or more well test devices, and where the time when material(s) are released is registered, and where arrival time of the formation fluids having the additional properties is registered at dedicated sensors comprised in the well test system when measuring and monitoring the additional properties of the formation fluids.

3. The method as claimed in claim 2, further comprising continuously measuring and monitoring the flow rate and pressure properties of the formation fluids, including the formation fluids having the additional properties, flowing into the annular space.

4. The method as claimed in claim 1, further comprising the rate of formation fluids flowing in the fluid communication path from said subsurface formation to the well test system being controlled by a fluid inlet and control valve.

5. The method as claimed in claim 2, further comprising determining geometric position of the primary wellbore and the secondary wellbore relative to each other based on travel time of the formation fluids having the additional properties when flowing from the primary wellbore to the secondary wellbore, using a simulation model to correlate tracer travel time with estimated spatial geometry.

6. The method as claimed in claim 2, further comprising measuring parameters in the well test system characterising the production process, the parameters include pressure, temperature, chemical tracer material signature, produced fluid chemical composition, chemical tracer release time, and time of measurements, and wherein said parameters are temporally correlated to tracer release events and formation flow behaviour to derive dynamic reservoir properties.

7. The method as claimed in claim 1, further comprising transmitting the measured parameters characterising the production process measured downhole, as well as system diagnostic to a surface system and/or to downhole tools controlling the testing operation.

8. The method as claimed in claim 1, further comprising the produced formation fluids are re-injected in an injection zone intersecting said secondary wellbore, and where the injection zone is established in a part of the subsurface formation having a permeability accepting injection of formation fluid by means of a downhole pump.

9. The method as claimed in claim 2, further comprising measuring and monitoring of the additional properties of the formation fluids is performed at different flowrates and by releasing additional chemical tracer materials, or other material(s) with distinct signature(s).

10. The method as claimed in claim 2, further comprising release of materials with distinct and different signatures are performed from different secondary wellbores and repeated using different compositions of the materials.

11. The method as claimed in claim 10, further comprising determining the directional anisotropy in permeability and other parameters of reservoir rock and fluids based on position, direction and distance of each of the different sidetracked wellbores relative to the secondary wellbore and measured travel time for each material with distinct signature in the direction of travel from each sidetracked wellbore to the secondary wellbore.

12. The method as claimed in claim 1, further comprising collecting at least one fluid sample, from the subsurface formation flowing into the well test system, in one or more sample chambers if measured properties of the fluid sample is according to pre-set criteria using a machine-learning classifier, and discarding other samples.

13. An apparatus for characterizing reservoir properties when producing formation fluids from a subsurface formation, comprising:

a primary wellbore intersecting the subsurface formation, a secondary wellbore intersecting the same subsurface formation as the primary wellbore, where the secondary wellbore is sidetracked from, or drilled in proximity to, said primary wellbore, one or more well test devices installed in a selected annular space in either the primary wellbore or the secondary wellbore, the selected annular space is isolated by means of an isolation packer arrangement, a well test system installed in a selected annular space in the other either primary wellbore or secondary wellbore, the selected annular space is isolated by means of an isolation packer arrangement, the well test system is connected to a well test control system attached to a test string, a fluid communication path established from said subsurface formation to the well test system for letting formation fluids from the subsurface formation flow into the selected annular space, and where the well test system comprises means for measuring and monitoring at least flow rate and pressure properties of produced formation fluids, characterized in further comprising activation means for activating the one or more well test devices, and where the well test system is adapted for measuring and monitoring additional properties of the formation fluids of the formation, located between the primary wellbore and the secondary wellbore, when the one or more well test devices are activated, one or more sample chambers for collecting samples of the subsurface formation fluid flowing into the well test system, a downhole pump configured for re-injecting fluids not required into the subsurface formation.

14. The apparatus as claimed in claim 13, further characterized by the one or more well test devices comprising a chemical tracer material chamber with a chemical tracer material release port for releasing chemical tracer material(s) or other material(s) with distinct signature(s), thereby providing the formation fluids with the additional properties, a downhole pump for pumping the chemical tracer material into the annular space where the well test device is installed, an electronics and memory module for controlling operation of the well test device(s) and a power supply for supplying power to the electronics and the downhole pump, and where the well test system comprises a chemical tracer detection module adapted for measuring and monitoring the additional properties of the one or more chemical tracer material(s) released from the well device when activated, and a power supply and an electronics and memory module for powering and controlling the well test system.

15. The apparatus as claimed in claim 14, further characterized by the well test device comprising a sensor module for measuring parameters related to the operation of each well test device, said parameters comprise pressure, temperature, time of release of said tracer material, and where the parameters are processed and stored by the electronics and memory module, the well test device further comprising an axial transmitter and receiver module for transmitting measured parameters uphole to the surface and/or a lateral transmitter and receiver module for transmitting measured parameters to the well test system or to the well test control system.

16. The apparatus as claimed in claim 14, further characterized by the one or more well test devices comprising a pre-programmed timer for activating release of the one or more chemical tracer material(s), or other material(s) with distinct signature(s).

17. The apparatus as claimed in claim 13, further characterized by the one or more well test devices comprising a receiver for receiving activation signals for activating release of one or more chemical tracer material(s), or other material(s) with distinct signature(s).

18. The apparatus as claimed in claim 13, further comprising a fluid inlet and control valve is installed in the fluid communication path, from said subsurface formation to the well test system, for controlling the flow rate of formation fluid into the well test system.

19. The apparatus as claimed in claim 13, further characterized by the well test system further comprising a sensor module for measuring temperature, chemical tracer material signature, produced fluid chemical composition, chemical tracer release time, and time of measurements.

20. The apparatus as claimed in claim 13, further comprising the well test device being mounted in a dedicated sidetrack drillstring, said sidetrack drillstring being connected to the well test control system by means of a wired mud motor and a wired sidetrack drillstring, or a wired sidetrack coil tubing.

21. The apparatus as claimed in claim 13, further comprising the downhole pump being configured for injecting produced formation fluid into a nearby injection zone, or for pumping the formation fluid into the sample chambers.

22. The apparatus as claimed in claim 15, further characterized by the well test system comprising an axial transmitter and receiver module for a two-way communication with the well test control system.

23. The apparatus as claimed in claim 15, further characterized by the well test system comprising a lateral transmitter and receiver module for receiving signals travelling through the formation from the lateral transmitter and receiver module in the well test device, or for transmitting signals to the well test device such as a command to release chemical tracer material.

24. The apparatus as claimed in claim 11, further characterized by the well test control system comprising a power supply or a turbine/alternator assembly, a sensor module, an electronics and memory module, and a transmitter and receiver module for providing two-way communication between the downhole well testing system and the surface, said communication comprises instruction commands transmitted from the surface and measurement signals transmitted from the well test control system.

25. The apparatus as claimed in claim 13, further characterized by the well test control system is being connected to the well testing system through a wired drill pipe, a wired coil tubing or a wired connection pipe.

26. The apparatus as claimed in claim 15, further characterized by the well test control system comprising an axial transmitter and receiver module for two-way communication with the axial transmitter and receiver module in the well test device.

* * * * *